US010807382B2

(12) United States Patent
Kubota et al.

(10) Patent No.: US 10,807,382 B2
(45) Date of Patent: Oct. 20, 2020

(54) TAPE PRINTING DEVICE, TAPE CARTRIDGE, AND TAPE CARTRIDGE SET

(71) Applicant: SEIKO EPSON CORPORATION, Tokyo (JP)

(72) Inventors: Tomoyuki Kubota, Matsumoto (JP); Kenji Motai, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/455,557

(22) Filed: Jun. 27, 2019

(65) Prior Publication Data

US 2020/0001619 A1 Jan. 2, 2020

(30) Foreign Application Priority Data

Jun. 28, 2018 (JP) ..... 2018-122822

(51) Int. Cl.
*B41J 2/32* (2006.01)
*B41J 2/325* (2006.01)
*B41J 32/00* (2006.01)

(52) U.S. Cl.
CPC ..... *B41J 2/325* (2013.01); *B41J 32/00* (2013.01)

(58) Field of Classification Search
CPC ... B41J 32/00; B41J 2/325; B41J 35/28; B41J 3/407
See application file for complete search history.

(56) References Cited

U.S. PATENT DOCUMENTS

| | | | | |
|---|---|---|---|---|
| 5,374,132 | A | 12/1994 | Kimura | |
| 5,538,352 | A | 7/1996 | Sugiura | |
| 9,469,139 | B2 | 10/2016 | Sakano et al. | |
| 9,815,310 | B2 | 11/2017 | Sakano et al. | |
| 10,286,700 | B2 | 5/2019 | Sakano et al. | |
| 2010/0247208 | A1 | 9/2010 | Yamaguchi et al. | |
| 2010/0247212 | A1 | 9/2010 | Yamaguchi et al. | |
| 2012/0009001 | A1* | 1/2012 | Sago | B41J 11/009 400/613 |
| 2012/0080550 | A1 | 4/2012 | Yamaguchi et al. | |
| 2014/0175204 | A1 | 6/2014 | Yamaguchi et al. | |
| 2015/0283835 | A1 | 10/2015 | Sakano et al. | |

(Continued)

FOREIGN PATENT DOCUMENTS

| | | | |
|---|---|---|---|
| CN | 1397431 | A | 2/2003 |
| CN | 106132715 | A | 11/2016 |

(Continued)

*Primary Examiner* — Kristal Feggins
(74) *Attorney, Agent, or Firm* — Oliff PLC

(57) ABSTRACT

A tape printing device includes a cartridge mounting portion on which a tape cartridge is mounted, a detection unit that has a first detection member configured to be protruded from and retracted into a first detection opening provided on a bottom surface of the cartridge mounting portion, and detects a type of a printing tape accommodated in the tape cartridge, and a thermal head that performs printing on the printing tape. A portion of the first detection member, exposed from the first detection opening, is located outside the tape accommodating area and is provided at a position on a side of the tape accommodating area different from a side of a first area in a plan view when the tape cartridge is mounted on the cartridge mounting portion.

14 Claims, 13 Drawing Sheets

(56) References Cited

U.S. PATENT DOCUMENTS

| | | | | |
|---|---|---|---|---|
| 2015/0283837 | A1* | 10/2015 | Sakano | B41J 32/02 347/214 |
| 2016/0229210 | A1 | 8/2016 | Yamaguchi et al. | |
| 2016/0271980 | A1* | 9/2016 | Sasaki | B41J 17/32 |
| 2017/0008323 | A1 | 1/2017 | Sakano et al. | |
| 2017/0100948 | A1* | 4/2017 | Yamaguchi | B41J 15/044 |
| 2018/0043714 | A1 | 2/2018 | Sakano et al. | |

FOREIGN PATENT DOCUMENTS

| | | | |
|---|---|---|---|
| JP | H06-122249 | | 5/1994 |
| JP | H07-089196 | | 4/1995 |
| JP | 2002-166605 | A | 6/2002 |
| JP | 2010-234774 | A | 10/2010 |

* cited by examiner

TAPE PRINTING DEVICE, TAPE CARTRIDGE, AND TAPE CARTRIDGE SET

The present application is based on, and claims priority from JP Application Serial Number 2018-122822, filed Jun., 28, 2018, the disclosure of which is hereby incorporated by reference herein in its entirety.

BACKGROUND

1. Technical Field

The present disclosure relates to a tape printing device, a tape cartridge, and a tape cartridge set.

2. Related Art

In the related art, a tape printing device that has three detectors configured to be protruded from and retracted into a bottom surface of a cartridge mounting portion and for discriminating the type of a tape cartridge mounted on the cartridge mounting portion has been known as disclosed in JP-A-2002-166605.

In the tape cartridge according to the related art, portions to be detected corresponding to the three detectors are provided to be selectively pressed downward by an inner side wall portion of a cartridge case. Meanwhile, since the type of the tape cartridge is increasing year by year, it is required to additionally provide detectors for discriminating the type of the tape cartridge on a bottom surface of the cartridge mounting portion. Further, it is required to maintain volume efficiency of the tape cartridge.

SUMMARY

According to an aspect of the present disclosure, a tape printing device includes a cartridge mounting portion on which a tape cartridge is mounted, a detection unit that has an actuator configured to be protruded from and retracted into a detection opening provided on a bottom surface of the cartridge mounting portion, and detects a type of a printing tape accommodated in the tape cartridge, and a thermal head that performs printing on the printing tape, in which the tape cartridge has a cartridge case having a bottom wall portion facing the bottom surface of the cartridge mounting portion when the tape cartridge is mounted on the cartridge mounting portion and a peripheral wall portion standing upright from a peripheral edge portion of the bottom wall portion, the cartridge case includes an ink ribbon accommodating area accommodating an ink ribbon, a sending-out core on which the ink ribbon is wound, and a winding core on which the ink ribbon is wound, a head insertion hole into which the thermal head and a head cover covering the thermal head are inserted when the tape cartridge is mounted on the cartridge mounting portion, a first area including the ink ribbon accommodating area and the head insertion hole, and a tape accommodating area accommodating the printing tape and a tape core on which the printing tape is wound, and a portion of the actuator, exposed from the detection opening, is located outside the tape accommodating area and is provided at a position on a side of the tape accommodating area different from a side of the first area in a plan view when the tape cartridge is mounted on the cartridge mounting portion.

According to another aspect of the present disclosure, a tape cartridge is configured to be mounted on a cartridge mounting portion of a tape printing device, the tape printing device including a first protrusion portion provided at a position, corresponding to a tape roller, on a bottom surface of the cartridge mounting portion, a platen shaft provided on the bottom surface of the cartridge mounting portion, a second protrusion portion provided on the bottom surface of the cartridge mounting portion, and a detection unit having an actuator configured to be protruded from and retracted into the bottom surface of the cartridge mounting portion and a main sensor body configured to generate a detection signal based on a position of the actuator, the first protrusion portion being located between the second protrusion portion or the actuator and the platen shaft, the tape cartridge including a cartridge case having a recess portion and an opening into which the second protrusion portion is inserted, and accommodating the tape roller, and a platen roller which is disposed inside the cartridge case and into which the platen shaft is inserted, in which in the cartridge case, in a state in which the tape cartridge is mounted on the cartridge mounting portion, the recess portion serving as a portion to be detected is provided at a position overlapping with the actuator, in a plan view.

According to still another aspect of the present disclosure, a tape cartridge is configured to be mounted on a cartridge mounting portion of a tape printing device, the tape printing device including a first protrusion portion provided at a position, corresponding to a tape roller, on a bottom surface of the cartridge mounting portion, a platen shaft provided on the bottom surface of the cartridge mounting portion, a second protrusion portion provided on the bottom surface of the cartridge mounting portion, and a detection unit having an actuator configured to be protruded from and retracted into a surface of the cartridge mounting portion and a main sensor body configured to generate a detection signal based on a position of the actuator, the first protrusion portion being located between the second protrusion portion or the actuator and the platen shaft, the tape cartridge including a cartridge case having an opening into which the second protrusion portion is inserted and accommodating the tape roller, and a platen roller which is disposed inside the cartridge case, and into which the platen shaft is inserted, in which in the cartridge case, in a state in which the tape cartridge is mounted on the cartridge mounting portion, an area to be detected where the actuator is located is provided.

According to still another aspect of the present disclosure, a tape cartridge mounted on a cartridge mounting portion of a tape printing device including the cartridge mounting portion, a detection unit that detects a type of a printing tape of the tape cartridge using an actuator configured to be protruded from and retracted into a detection opening provided on a bottom surface of the cartridge mounting portion, and a thermal head that performs printing on the printing tape, includes a cartridge case including a bottom wall portion facing the bottom surface of the cartridge mounting portion and a peripheral wall portion standing upright from a peripheral edge portion of the bottom wall portion in a state in which the tape cartridge is mounted on the cartridge mounting portion, in which the cartridge case includes an ink ribbon accommodating area accommodating an ink ribbon, a sending-out core on which the ink ribbon is wound, and a winding core on which the ink ribbon is wound, a head insertion hole into which the thermal head is inserted when the tape cartridge is mounted on the cartridge mounting portion, a first area configured with the ink ribbon accommodating area and the head insertion hole, and a tape accommodating area accommodating the printing tape and a tape core on which the printing tape is wound, and in a plan view when the tape cartridge is mounted on the cartridge mounting portion, an area, corresponding to a portion of the actuator exposed from the detection opening, in the bottom wall portion of the cartridge case is located outside the tape accommodating area, and is located opposite to the first area with the tape accommodating area in between.

According to still another aspect of the present disclosure, a tape cartridge, which is mounted on a cartridge mounting portion of a tape printing device including the cartridge mounting portion, and a detection unit that detects a type of a printing tape of the tape cartridge using an actuator configured to be protruded from and retracted into a detection opening provided on a bottom surface of the cartridge mounting portion, includes a cartridge case including a bottom wall portion including an opposite surface facing the bottom surface of the cartridge mounting portion and a peripheral wall portion standing upright from a peripheral edge portion of the bottom wall portion when the tape cartridge is mounted on the cartridge mounting portion, in which an area to be detected, detected by the actuator protruding from the detection opening of the tape printing device when the tape cartridge is mounted on the cartridge mounting portion, is provided in the peripheral edge portion from which the peripheral wall portion stands upright on the opposite surface of the bottom wall portion.

According to still another aspect of the present disclosure, a tape cartridge set has a first cartridge and a second cartridge and is configured to be mounted on a cartridge mounting portion of a tape printing device. The tape printing device includes a first protrusion portion provided at a position, corresponding to a tape roller, on a bottom surface of the cartridge mounting portion, a platen shaft provided on the bottom surface of the cartridge mounting portion, a second protrusion portion provided on the bottom surface of the cartridge mounting portion, and a detection unit including an actuator configured to be protruded from and retracted into a detection opening provided in the cartridge mounting portion and a main sensor body configured to generate a detection signal based on a position of the actuator, the main sensor body generating a first detection signal based on a first detection position of the actuator, when the first cartridge is mounted on the cartridge mounting portion, the main sensor body generating a second detection signal based on a second detection position of the actuator, when the second cartridge is mounted on the cartridge mounting portion, the second protrusion portion and the actuator being located in an area opposite to the platen shaft with the first protrusion portion in between, in which the actuator is retracted into the detection opening, when the first cartridge is mounted on the cartridge mounting portion, and the actuator is maintained to be protruded from the detection opening, when the second cartridge is mounted on the cartridge mounting portion, the first cartridge includes a first cartridge case having a first opening into which the second protrusion portion is inserted, a first tape roller disposed inside the first cartridge case, and a first platen roller which is disposed inside the first cartridge case and into which the platen shaft is inserted, and a first area to be detected in which the actuator of the tape printing device is located in the first detection position is provided in a state in which the first cartridge is mounted on the cartridge mounting portion, and the second cartridge includes a second cartridge case having a second opening into which the second protrusion portion is inserted, a second tape roller disposed inside the second cartridge case, and a second platen roller which is disposed inside the second cartridge case and into which the platen shaft is inserted, and a second area to be detected in which the actuator of the tape printing device is located at the second detection position is provided in a state in which the second cartridge is mounted on the cartridge mounting portion.

DESCRIPTION OF EXEMPLARY EMBODIMENTS

Figure 1:
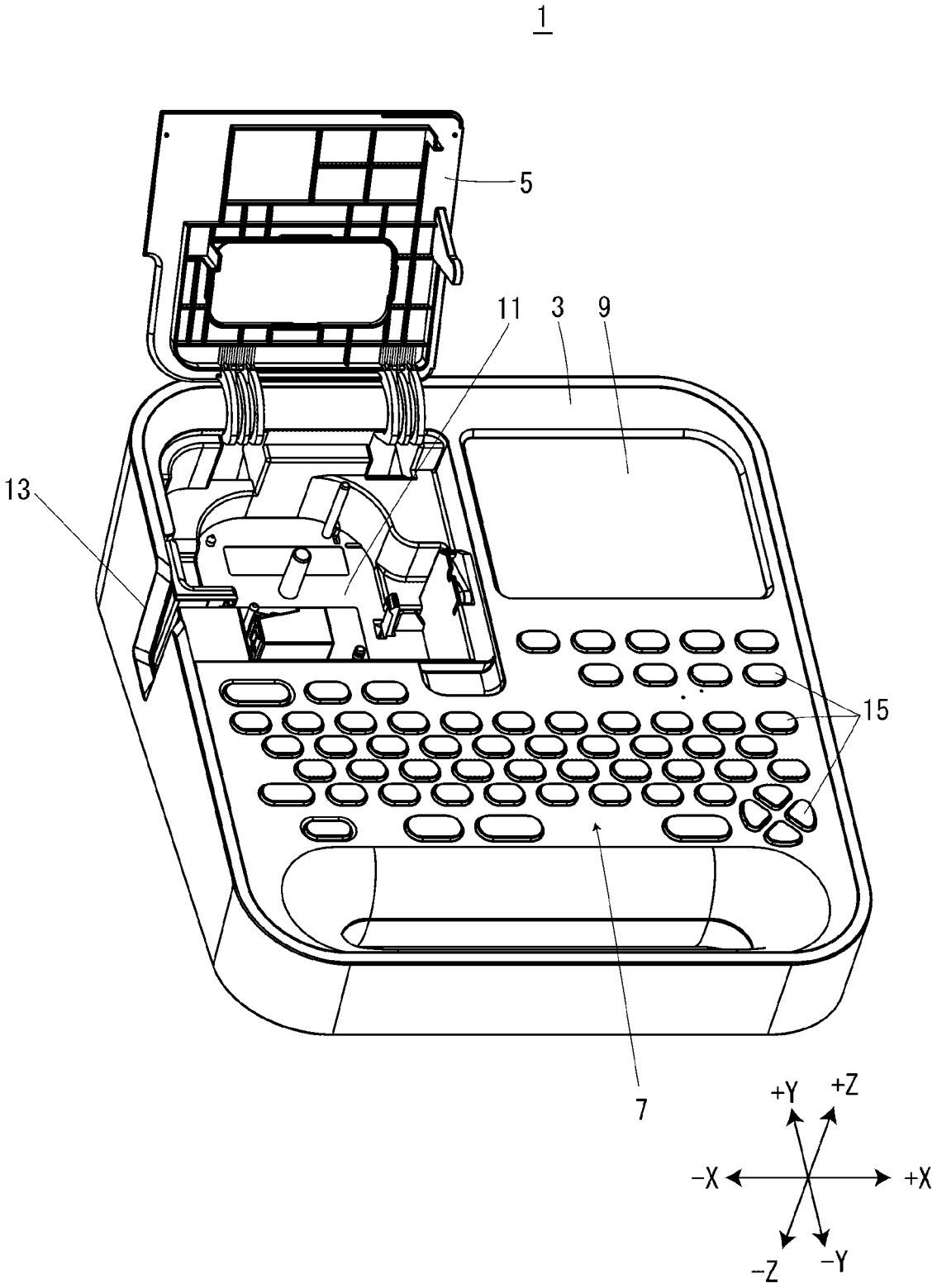
FIG. 1 is a perspective view illustrating a tape printing device according to an embodiment of the present disclosure.

Hereinafter, an embodiment of a tape printing device, a tape cartridge, and a tape cartridge set will be described with reference to the accompanying drawings. Numerical values indicating the number of components or the like are merely examples, and do not limit the present disclosure at all. Further, in the following drawings, in order to clarify an arrangement relationship between components, an XYZ orthogonal coordinate system is displayed, but does not limit the present disclosure at all.

A schematic configuration of the tape printing device 1 will be described with reference to FIGS. 1 and 2. The tape printing device 1 includes a device case 3 and a mounting portion cover 5. An operation panel 7, a display 9, and a cartridge mounting portion 11 are provided on one surface of the device case 3. A tape discharging port 13 is provided on another surface of the device case 3.

Buttons 15 such as a character button, a selection button, and a printing button are provided in the operation panel 7. The operation panel 7 accepts input operation of printing information such as a character string and various instructions such as printing execution.

The display 9 displays the input character string or the like, based on an input operation accepted by the operation panel 7. Further, the display 9 performs various displays, based on a result of detection by sensors provided in components of the tape printing device 1.

The mounting portion cover 5 opens and closes the cartridge mounting portion 11. The cartridge mounting portion 11 is formed to have a concave shape having one opened surface. A tape cartridge 101 is detachably mounted on the cartridge mounting portion 11.

When the operation panel 7 accepts an input operation of the printing execution, the tape printing device 1 executes a printing process, based on the printing information input from the operation panel 7. That is, the tape printing device 1 prints the input character string or the like on a tape 113 accommodated in the tape cartridge 101 while feeding the tape 113 toward the tape discharging port 13. The tape 113 is an example of a "printing tape" of the present disclosure.

Figure 2:
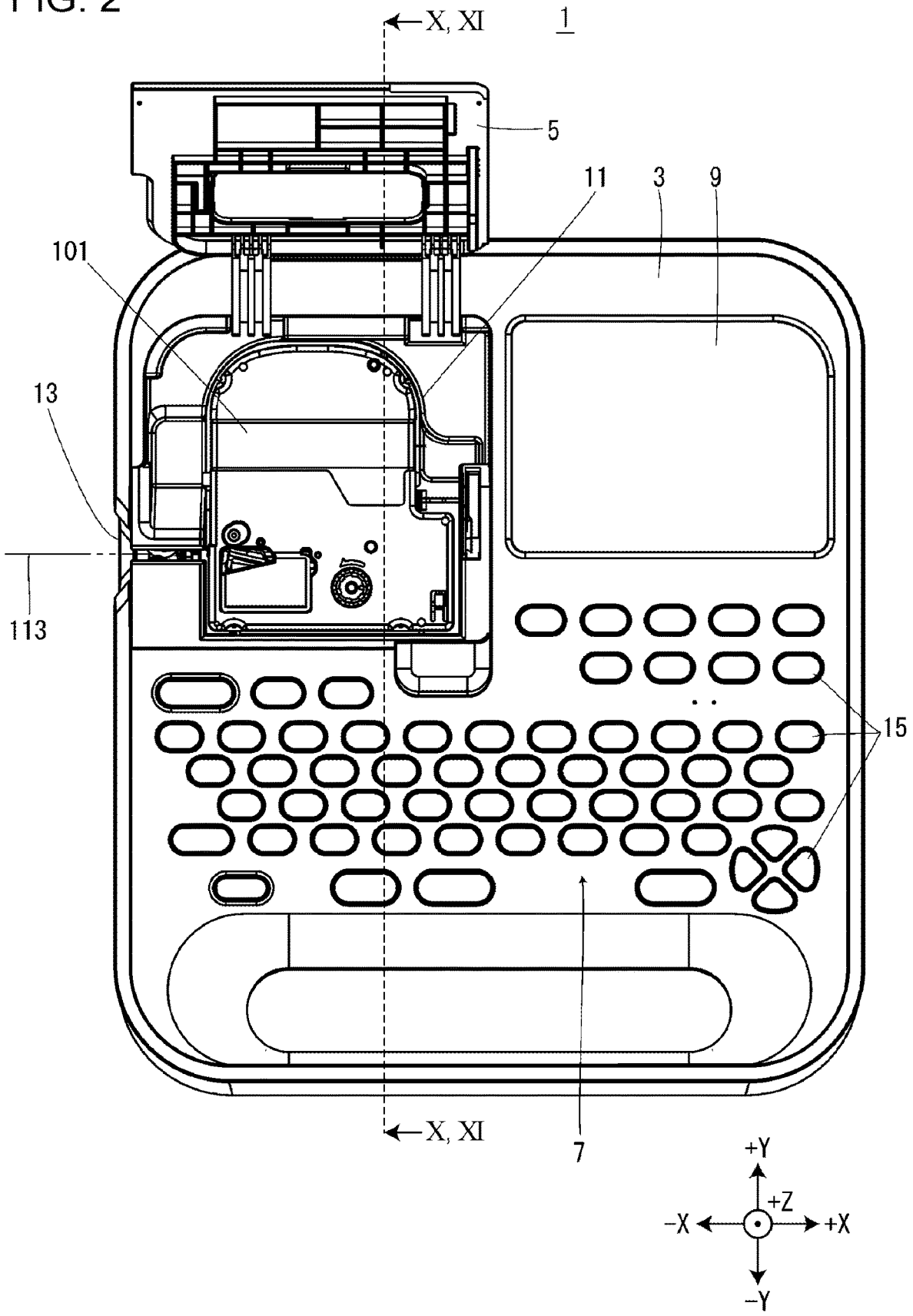
FIG. 2 is a view illustrating the tape printing device in a state in which a tape cartridge is mounted in a plan view from a nearby side in a mounting direction.
Figure 3:
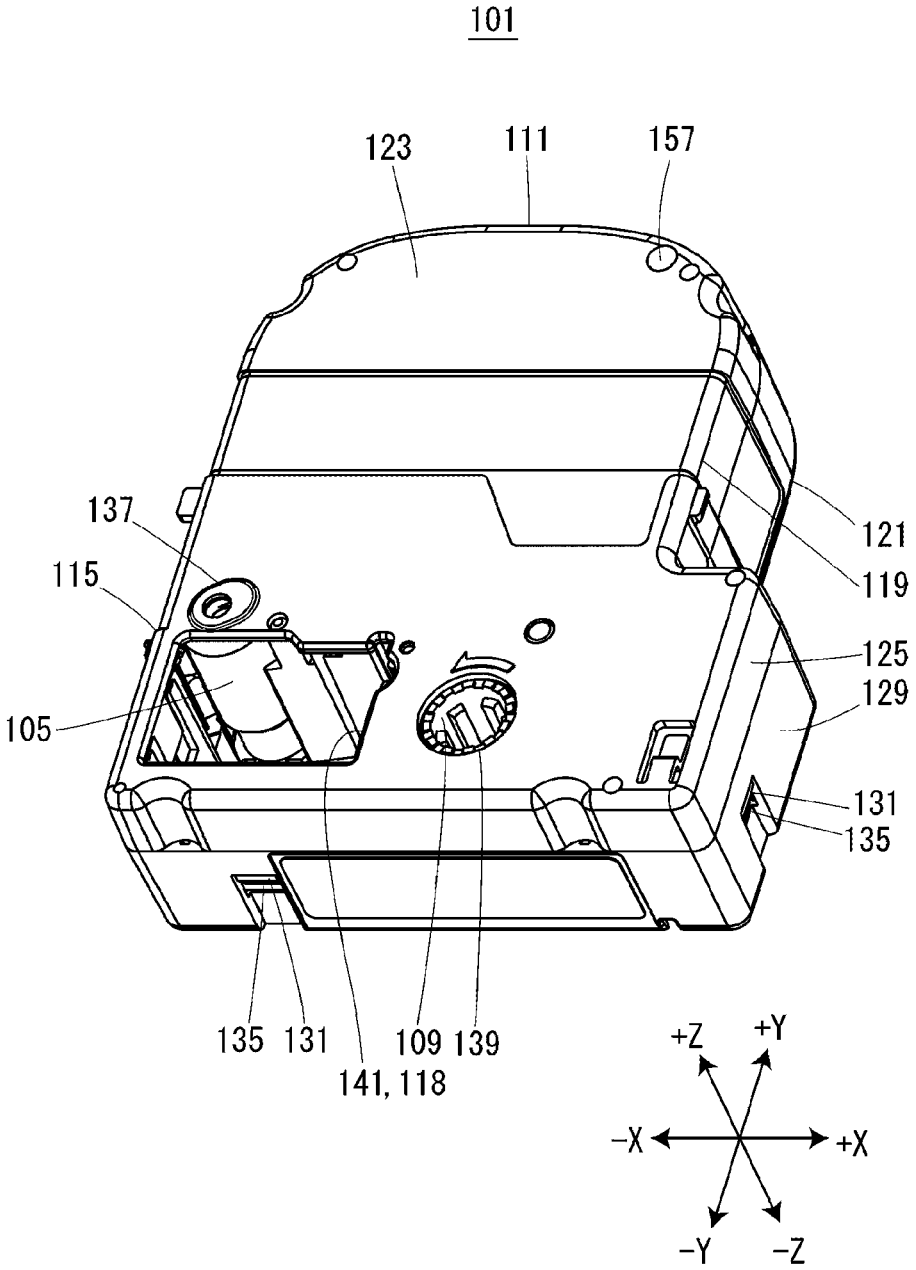
FIG. 3 is a perspective view illustrating the tape cartridge according to the embodiment of the present disclosure.
Figure 12:
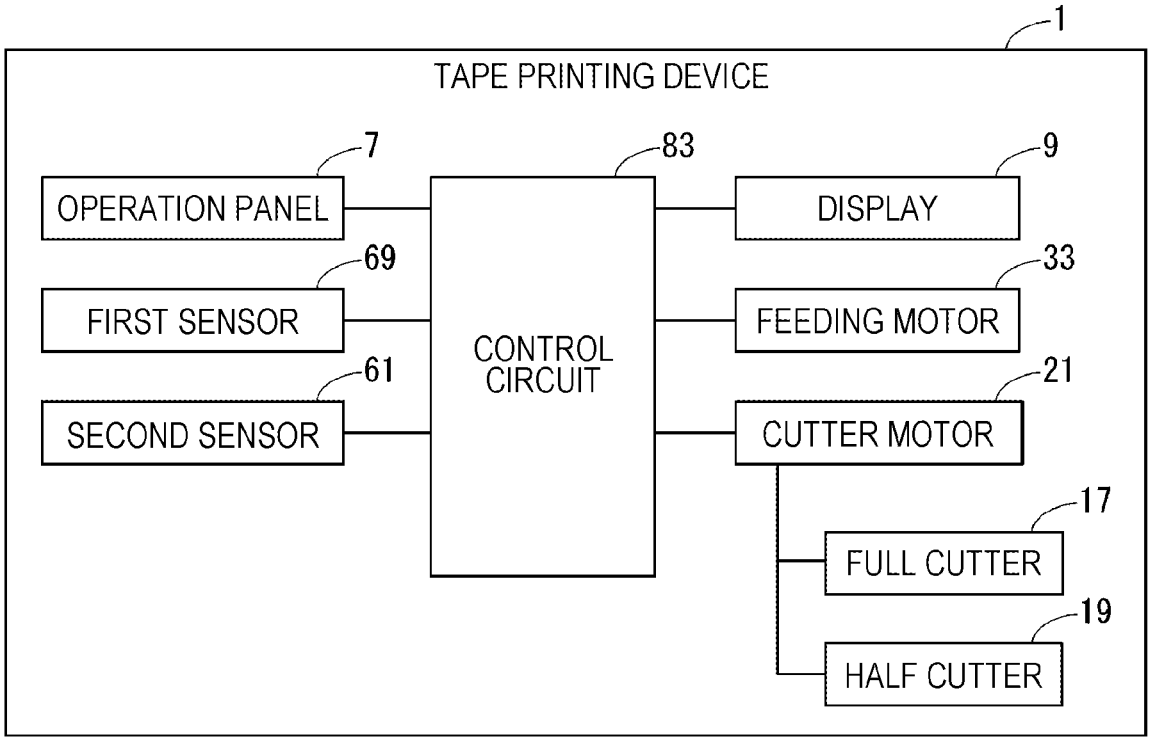
FIG. 12 is a block diagram illustrating the tape printing device.

Although not illustrated in FIGS. 1 and 2, a full cutter 17 and a half cutter 19 are provided between the cartridge mounting portion 11 and the tape discharging port 13 (see FIG. 12). The full cutter 17 cuts the tape 113 after a printed portion of the tape 113. The half cutter 19 forms cuts on one surface of the tape 113 without cutting the tape 113. The full cutter 17 and the half cutter 19 are operated using a cutter motor 21 (see FIG. 12) as a driving source. The tape printing device 1 may be configured to have only the full cutter 17 without the half cutter 19 and to cut the tape 113. Further, two cutter motors 21 may be provided, and the full cutter 17 and the half cutter 19 may be separately driven by the respective cutter motors 21. Further, without the cutter motor 21, a feeding motor 33, which will be described below, may be used as a driving source of both the full cutter 17 and the half cutter 19 or the full cutter 17.

The tape cartridge 101 will be described with reference to FIGS. 3 to 8. As will be described later in detail, the tape cartridge 101 includes a first cartridge 177 illustrated in FIG. 5 in which a detection recess portion 175 is not provided in a first detection area 171, and a second cartridge 179 illustrated in FIG. 6 in which the detection recess portion 175 is provided in the first detection area 171. The tape cartridge 101 includes a tape core 103, a platen roller 105, a sending-out core 107, a winding core 109, and a cartridge case 111 in which the tape core 103, the platen roller 105, the sending-out core 107, and the winding core 109 are rotatably accommodated. The tape 113 is wound on the tape core 103. The tape 113 sent out from the tape core 103 is fed out from a tape feeding-out port 115 provided on a side surface of the cartridge case 111 to the outside of the cartridge case 111. An ink ribbon 117 is wound around the sending-out core 107. The ink ribbon 117 sent out from the sending-out core 107 is wound on the winding core 109. Further, the combined weight of the tape 113 and the tape core 103 occupies 50% or more of the weight of the tape cartridge 101 in an unused state. In other words, a tape roller including the tape 113 and the tape core 103 has the largest weight among components constituting the tape cartridge 101.

A head insertion hole 118 is provided to penetrate the cartridge case 111 in a mounting direction of the tape cartridge 101. Here, the mounting direction of the tape cartridge 101 means a direction from a nearby side toward a deep side of the cartridge mounting portion 11, when the tape cartridge 101 is mounted on the cartridge mounting portion 11. Hereinafter, the mounting direction of the tape cartridge 101, that is, the—Z direction, is simply referred to as a "mounting direction". Further, hereinafter, viewing a plane perpendicular to the mounting direction, that is, the XY plane, from the +Z side or the −Z side is referred to as a "plan view".

Figure 4:
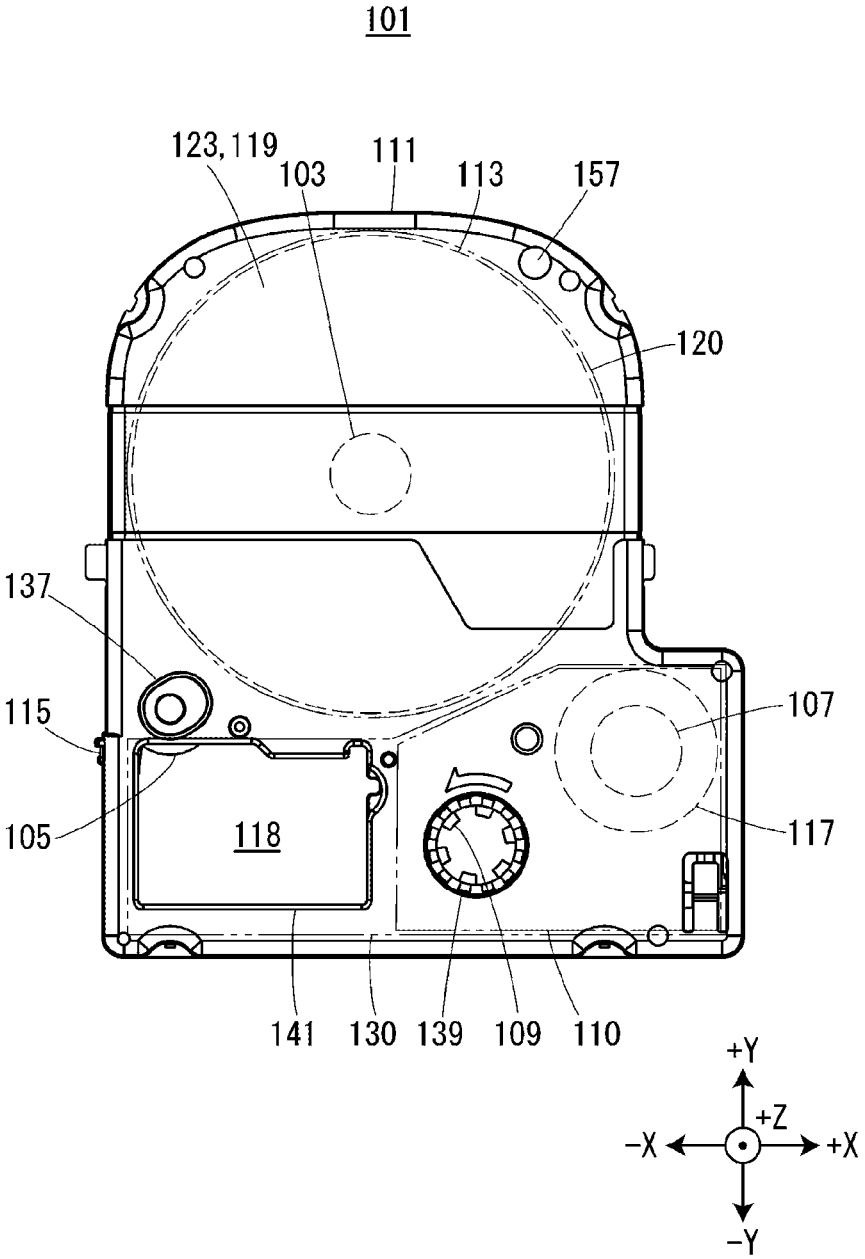
FIG. 4 is a view illustrating the tape cartridge in a plan view from the nearby side in the mounting direction.

Arrangement of the above-described components when the tape cartridge 101 is viewed in a plan view from the +Z side will be described based on FIG. 4. The cartridge case 111 has a shape obtained by connecting two substantially rectangular shapes having different sizes in a substantially L shape in a plan view. The head insertion hole 118 is formed to have a substantially rectangular shape in a plan view, and is provided inside the cartridge case 111 at a corner portion on the −X side and the −Y side of a first area 130, which will be described below. The platen roller 105 is provided on the +Y side and the −X side of the head insertion hole 118. Further, a part of the platen roller 105 protrudes from the +Y direction to the −Y direction inside the head insertion hole 118. The tape feeding-out port 115 is provided in a peripheral wall portion of the cartridge case 111 and is located on the −Y side of the platen roller 105. An ink ribbon accommodating area 110 for accommodating the sending-out core 107 around which the ink ribbon 117 is wound and the winding core 109 is provided on the +X side of the head insertion hole 118. An area including the ink ribbon accommodating area 110 and the head insertion hole 118 is referred to as the first area 130. The winding core 109 is provided on the +X side of the head insertion hole 118, and the ink ribbon 117 sent out from the sending-out core 107 and transported around the +Y side, the −X side, and the −Y side of the head insertion hole 118 is wound on the winding core 109. The sending-out core 107 is provided on the +X side and the +Y side of the winding core 109. A tape accommodating area 120 in which the tape core 103 having the tape 113 wound thereon is accommodated is provided on the +Y side of the head insertion hole 118 and the ink ribbon accommodating area 110. A peripheral wall portion of the tape accommodating area 120 on the −X side is formed to be flush with a peripheral wall portion in which the tape feeding-out port 115 is provided. Further, the peripheral wall portion of the tape accommodating area 120 on the +X side is provided on the −X side of the peripheral wall portion of the ink ribbon accommodating area 110 on the +X side. In other words, the length of the tape accommodating area 120 in an X direction is less than the length in the X direction of the first area 130 including the head insertion hole 118 and the ink ribbon accommodating area 110. Further, a peripheral wall portion where the peripheral wall portion of the tape accommodating area 120 in the +Y direction crosses the peripheral wall portion of the tape accommodating area 120 on the +X side or the peripheral wall portion of the tape accommodating area 120 on the −X side is formed into a curved surface chamfered in an arc shape in a plan view.

The cartridge case 111 includes a nearby side case 119 and a deep side case 121. When the tape cartridge 101 is mounted on the cartridge mounting portion 11, the nearby side case 119 is on a nearby side in the mounting direction. When the tape cartridge 101 is mounted on the cartridge mounting portion 11, the deep side case 121 is on a deep side in the mounting direction. The nearby side case 119 is a molded product made of resin having transmittance, and the deep side case 121 is a molded product made of resin not having transmittance. However, materials and manufacturing methods of the nearby side case 119 and the deep side case 121 are not limited thereto. The nearby side case 119 and the deep side case 121 are examples of a "first case" and a "second case" of the present disclosure.

The nearby side case 119 includes a nearby side wall portion 123 and a first peripheral wall portion 125 standing upright from a peripheral edge portion of the nearby side wall portion 123 on the deep side in the mounting direction. The deep side case 121 includes a deep side wall portion 127 and a second peripheral wall portion 129 standing upright from a peripheral edge portion of the deep side wall portion 127 on the nearby side in the mounting direction. The second peripheral wall portion 129 is an example of a "peripheral wall portion" of the present disclosure. The deep side wall portion 127 is an example of a "bottom wall portion" of the present disclosure.

Six assembly pins (not illustrated) and two assembly hooks 131 are provided in the nearby side wall portion 123. Meanwhile, six assembly pin insertion holes 133 are provided in the deep side wall portion 127, and two assembly hook engaging portions 135 are provided in the second peripheral wall portion 129. When the nearby side case 119 and the deep side case 121 are combined, the assembly pins are press-fitted to the assembly pin insertion holes 133, and the assembly hooks 131 and the assembly hook engaging portions 135 are engaged. The nearby side case 119 and the deep side case 121 may be configured such that the six assembly pin insertion holes 133 are provided in the nearby side wall portion 123 and the six assembly pins are provided in the deep side wall portion 127.

A nearby side platen support portion 137, a nearby side sending-out support portion (not illustrated), a nearby side winding support portion 139, and a nearby side head opening 141 are provided in the nearby side wall portion 123. A core insertion tube portion 143, a deep side platen support portion 145, a deep side sending-out support portion 147, a deep side winding support portion 149, and a deep side head opening 151 are provided in the deep side wall portion 127.

The core insertion tube portion 143 is formed to have a stepped cylindrical shape, and is inserted into the tape core 103. That is, the tape core 103 rotates about the core insertion tube portion 143 as a rotation shaft. An insertion hole into which an insertion protrusion portion 23, which will be described below, is inserted and a reverse rotation preventing spring (not illustrated) are provided in an inner circumferential portion of the core insertion tube portion 143. The reverse rotation preventing spring is configured with a compression coil spring. When the tape cartridge 101 is not mounted on the cartridge mounting portion 11, the reverse rotation preventing spring prevents the tape core 103 from rotating in a direction opposite to a direction in which the tape 113 is sent out, by engaging, with the tape core 103, an end portion of the reverse rotation preventing spring on the deep side in the mounting direction.

The nearby side platen support portion 137 and the deep side platen support portion 145 rotatably support the platen roller 105. The nearby side sending-out support portion and the deep side sending-out support portion 147 rotatably support the sending-out core 107. The nearby side winding support portion 139 and the deep side winding support portion 149 rotatably support the winding core 109. The nearby side head opening 141 constitutes an end portion of the head insertion hole 118 on the nearby side in the mounting direction, and the deep side head opening 151 constitutes an end portion of the head insertion hole 118 on the deep side in the mounting direction.

A sending-out side hook 153 and a winding side hook 155 are provided in the deep side wall portion 127. A leading end portion of the sending-out side hook 153 is engaged with an end portion of the sending-out core 107 on the deep side in the mounting direction, and a leading end portion of the winding side hook 155 is engaged with an end portion of the winding core 109 on the deep side in the mounting direction. Accordingly, before the tape cartridge 101 is mounted on the cartridge mounting portion 11, slack in the ink ribbon 117 by the rotation of the sending-out core 107 and the winding core 109 is prevented.

A first guide hole 157 is provided in the nearby side wall portion 123. Meanwhile, a second guide hole 159 is provided in the deep side wall portion 127. The second guide hole 159 is provided at a position overlapping with the first guide hole 157 when viewed from the nearby side in the mounting direction. When the tape cartridge 101 is mounted on the cartridge mounting portion 11, guide pins 45, which will be described below, are inserted into the first guide hole 157 and the second guide hole 159 to guide mounting of the tape cartridge 101. The first guide hole 157 may not be provided when the guide pin 45 does not come into contact with the nearby side wall portion 123 or is not inserted into the nearby side wall portion 123 due to a correlation between the protrusion height of the guide pin 45 and the thickness of the tape cartridge 101. The "first guide hole 157" and the "second guide hole 159" are examples of "openings" of the present disclosure.

A first positioning hole 161 and a second positioning hole 163 are provided on a surface of the deep side wall portion 127 on the deep side in the mounting direction. Two pressing engagement portions 165 are provided on an outer peripheral surface of the second peripheral wall portion 129.

A first detection area 171 and a second detection area 167 are provided on the surface of the deep side wall portion 127 on the deep side in the mounting direction. The first detection area 171 and the second detection area 167 are provided to enable the tape printing device 1 to detect the type of the tape 113 accommodated in the cartridge case 111 through respective detection members, which will be described below. The first detection area 171 is an example of an "area to be detected" of the present disclosure. The second detection area 167 basically has the same configuration as the portion to be detected disclosed in the above-described related art.

The second detection area 167 is an area corresponding to three second detection members 63 (see FIG. 9), which will be described below, in the surface of the deep side wall portion 127 on the deep side in the mounting direction, and holes to be detected 173 are selectively provided at three points corresponding to the three second detection members 63. That is, in the second detection area 167, combination of presence or absence of the three holes to be detected 173 differs according to a type of the tape 113 accommodated in the cartridge case 111.

The first detection area 171 is an area corresponding to a first detection member 71 (see FIG. 9), which will be described below, in the surface of the deep side wall portion 127 on the deep side in the mounting direction, and the detection recess portion 175 is selectively provided in the first detection area 171. In other words, in a plan view, the first detection area 171 is provided at a position overlapping with the first detection member 71. In the first detection area 171, the detection recess portion 175 may be provided or may not be provided according to the type of the tape 113 accommodated in the tape cartridge 101. The detection recess portion 175 is formed in a concave shape of which the deep side in the mounting direction and an outer peripheral surface side are opened. Further, in a plan view, the first detection area 171 is provided outside the tape accommodating area 120, is provided opposite to the first area 130, and eventually is provided at a position different from the first area 130 side. The surface of the deep side wall portion 127 on the deep side in the mounting direction is an example of an "opposite surface" of the present disclosure. The detection recess portion 175 is an example of a "recess portion" of the present disclosure.

Figure 5:
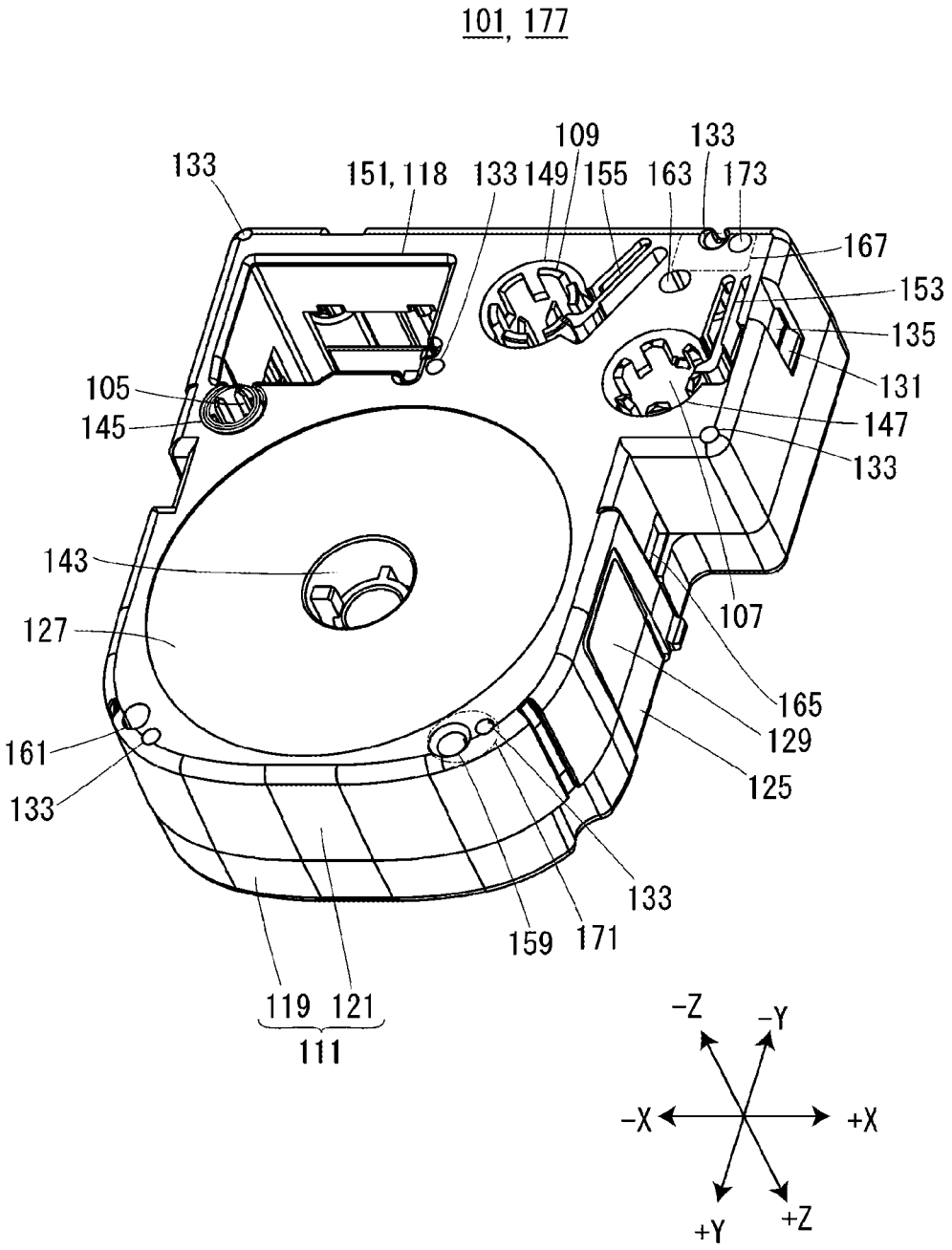
FIG. 5 is a perspective view illustrating a first cartridge.
Figure 6:
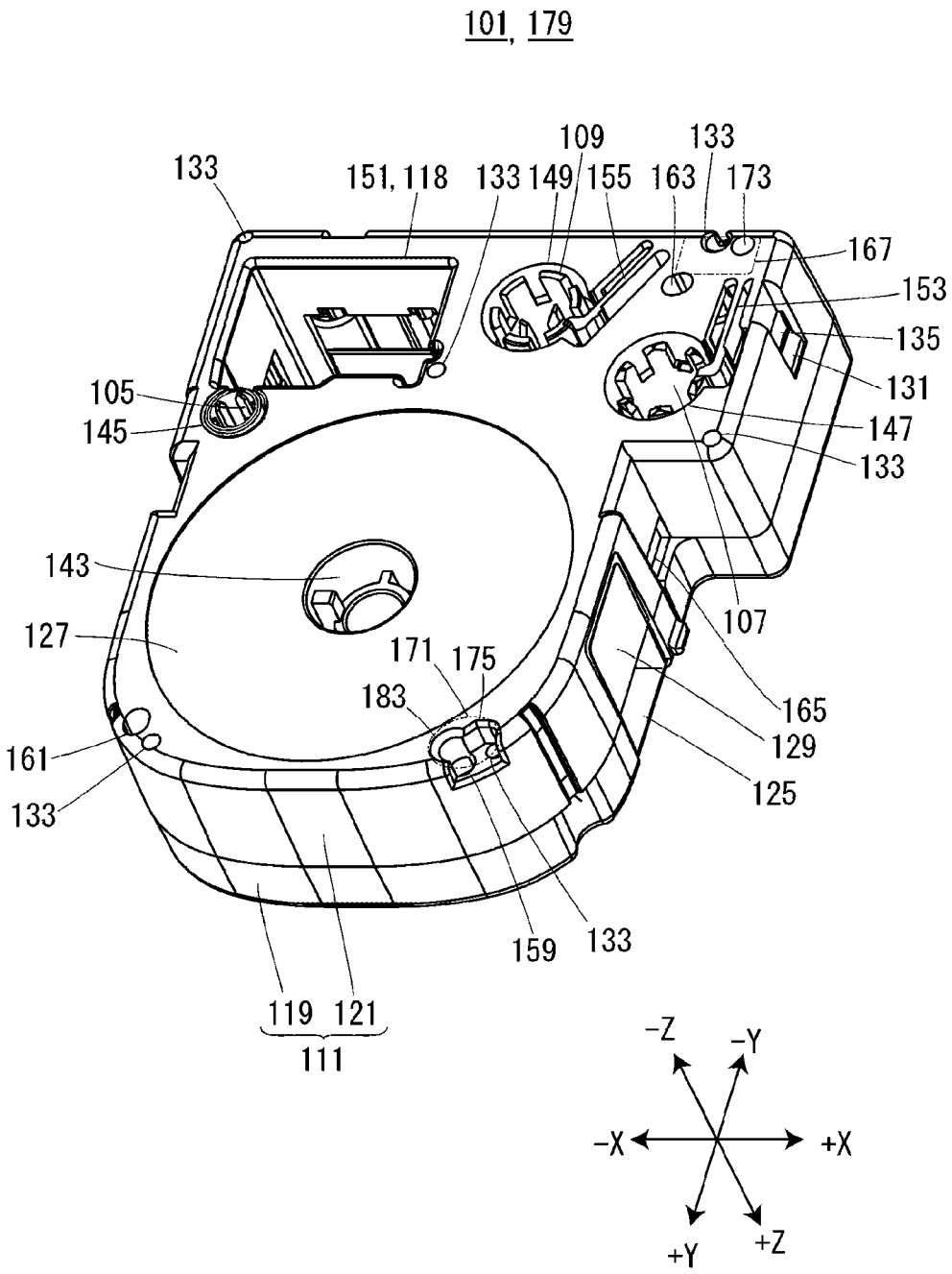
FIG. 6 is a perspective view illustrating a second cartridge.
Figure 7:
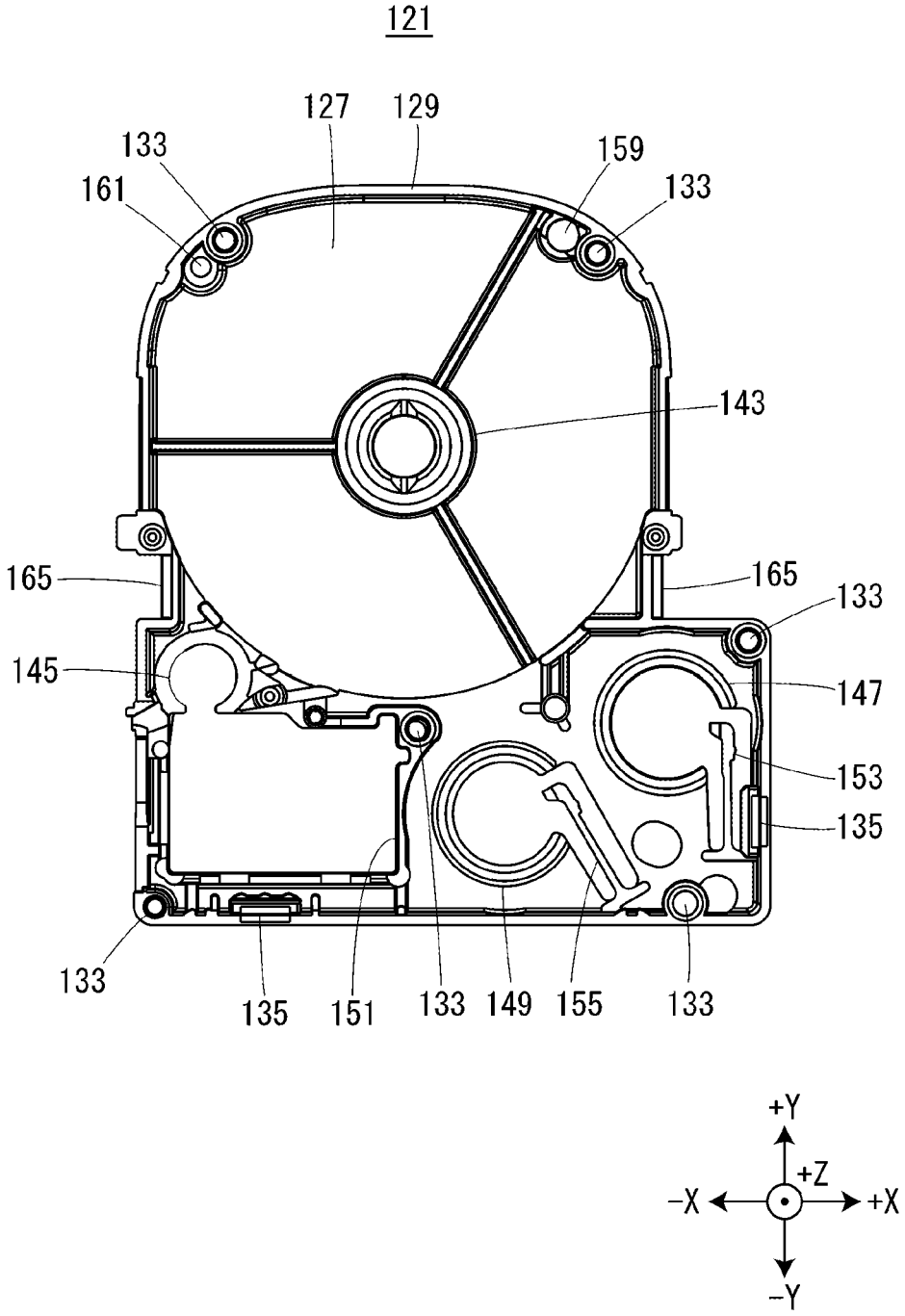
FIG. 7 is a view illustrating a deep side case in a plan view from the nearby side in the mounting direction.

Among tape cartridges 101, as illustrated in FIG. 5, a tape cartridge in which the detection recess portion 175 is not provided in the first detection area 171 is referred to as the first cartridge 177. As illustrated in FIG. 6, a tape cartridge in which the detection recess portion 175 is provided in the first detection area 171 is referred to as the second cartridge 179. The first cartridge 177 is an example of the "first cartridge" of the present disclosure, and the second cartridge 179 is an example of the "second cartridge" of the present disclosure. Further, for example, the first cartridge 177 and the second cartridge 179 are included in a "tape cartridge set" of the present disclosure. A tape 113, which does not affect a cutting function of the full cutter 17 and the half cutter 19, is accommodated in the first cartridge 177. Meanwhile, A tape 113, which affects a cutting function of the full cutter 17 and the half cutter 19, is accommodated in the second cartridge 179. The first cartridge 177 and the second cartridge 179 are alternatively mounted on the cartridge mounting portion 11.

Figure 8:
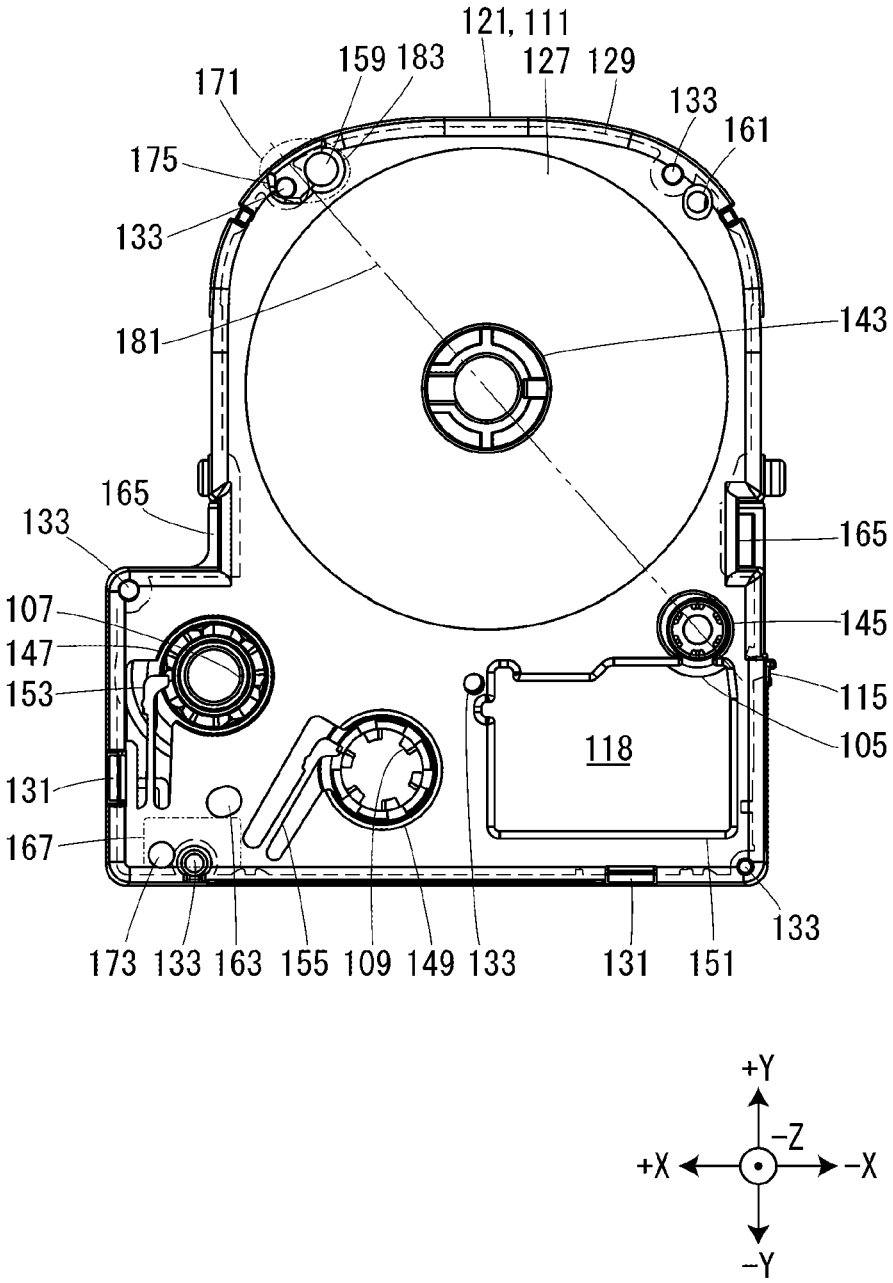
FIG. 8 is a view illustrating the second cartridge in a plan view from a deep side in the mounting direction.

Here, the first detection area 171 is provided at a position overlapping with the second peripheral wall portion 129, one of the assembly pin insertion holes 133, the second guide hole 159, and a guide recess portion 183 when viewed from the deep side in the mounting direction (see FIG. 8). In FIG. 8, a contour line on an inner side of the second peripheral wall portion 129 is indicated by a broken line. Further, the first detection area 171 is provided over a cartridge side imaginary line 181 passing through the center of the core insertion tube portion 143 and the center of the platen roller 105 when viewed from the deep side in the mounting direction (see FIG. 8). In other words, the first detection area 171 is provided in an area opposite to the platen roller 105 with the core insertion tube portion 143 in between. As described above, the first detection area 171 is provided at a position overlapping with one assembly pin insertion hole 133 among the six assembly pin insertion holes 133, when viewed from the deep side in the mounting direction. That is, the assembly pin insertion hole 133 is opened on the bottom surface of the detection recess portion 175. A distance between an outer peripheral surface of the tape 113 wound on the tape core 103 and an inner peripheral surface of the second peripheral wall portion 129 is largely made in an area including the assembly pin insertion hole 133 such that the assembly pin insertion hole 133 is provided. Thus, since the first detection area 171 is provided in the area including the assembly pin insertion hole 133, influence on accommodation and transport of the tape 113 accommodated in the tape cartridge 101 can be suppressed.

Further, the guide recess portion 183 is provided at a position overlapping with the second guide hole 159 in the second cartridge 179, when viewed from the deep side in the mounting direction. That is, the second guide hole 159 is opened on the bottom surface of the guide recess portion 183. When the second cartridge 179 is mounted on the cartridge mounting portion 11, the guide pin 45 is inserted into the guide recess portion 183 and the second guide hole 159 in this order. Similarly to the detection recess portion 175, the guide recess portion 183 is formed in a concave shape of which the deep side in the mounting direction and an outer peripheral surface side are opened. The detection recess portion 175 is provided continuously with the guide recess portion 183. The detection recess portion 175 is not limited to have the configuration in which the detection recess portion 175 is provided continuously with the guide recess portion 183, and may have a configuration in which the detection recess portion 175 and the guide recess portion 183 are separated from each other. Alternatively, the second cartridge 179 may not include the guide recess portion 183.

Figure 9:
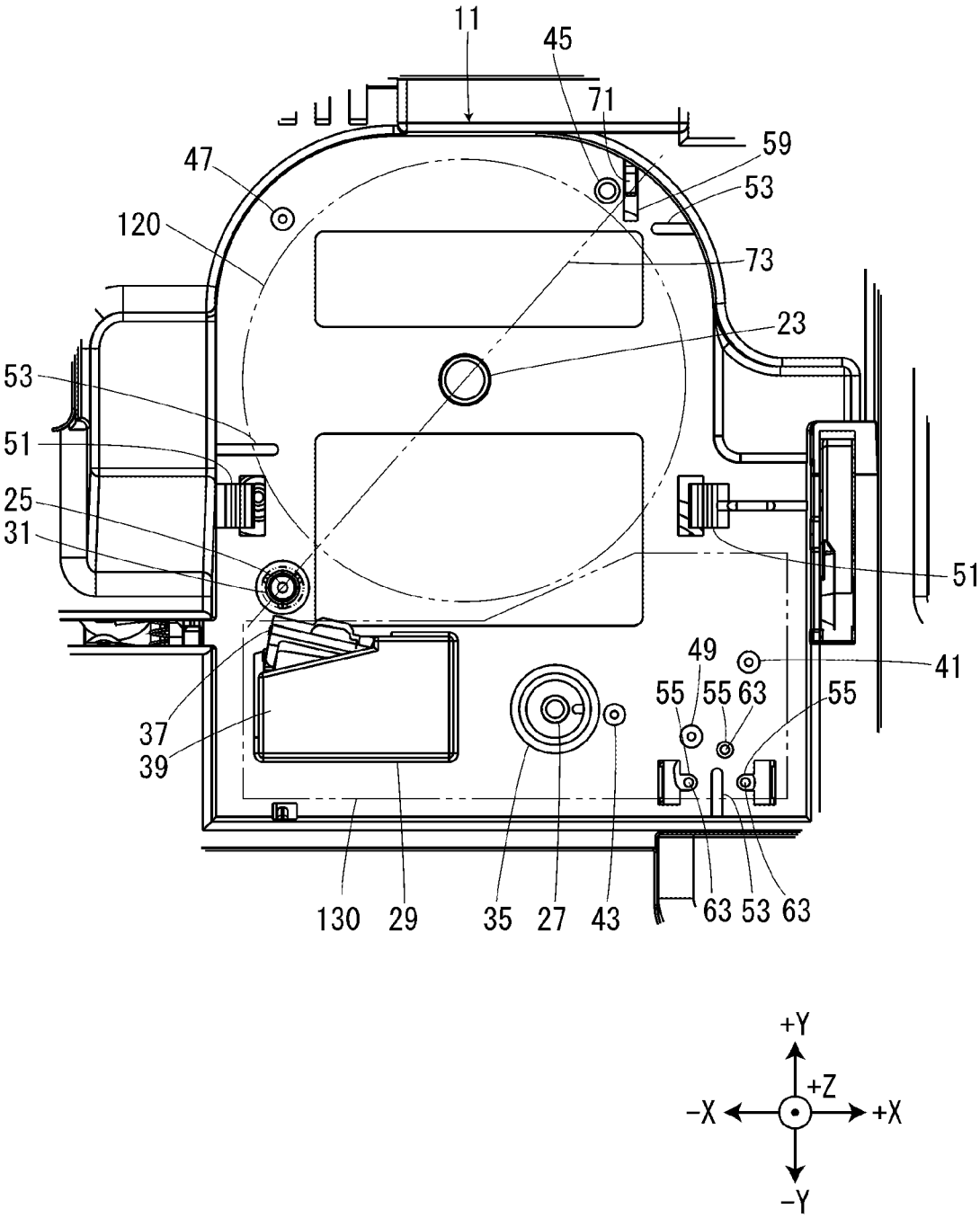
FIG. 9 is a view illustrating a cartridge mounting portion in a plan view from the nearby side in the mounting direction.

A configuration around the cartridge mounting portion 11 will be described based on FIG. 9. An insertion protrusion portion 23, a platen shaft 25, a winding shaft 27, and a head portion 29 protrude from the bottom surface of the cartridge mounting portion 11 to the nearby side in the mounting direction.

When the tape cartridge 101 is mounted on the cartridge mounting portion 11, the insertion protrusion portion 23 is inserted into the core insertion tube portion 143. Accordingly, since the reverse rotation preventing spring provided inside the core insertion tube portion 143 is compressed, and the engagement between the reverse rotation preventing spring and the tape core 103 is released, the tape core 103 can freely rotate. The insertion protrusion portion 23 is an example of a "protrusion portion" or a "first protrusion portion" of the present disclosure.

The platen rotating member 31 is rotatably provided around the platen shaft 25. When the tape cartridge 101 is mounted on the cartridge mounting portion 11, the platen shaft 25 is inserted into the platen roller 105, and the platen rotating member 31 is engaged with the platen roller 105. In this state, when the feeding motor 33 (see FIG. 12) is operated, as the platen rotation member 31 rotates, the platen roller 105 rotates, and the tape 113 and the ink ribbon 117 sandwiched between the platen roller 105 and a thermal head 37, which will be described below, are sent out.

A winding rotation member 35 is rotatably provided in the winding shaft 27. When the tape cartridge 101 is mounted on the cartridge mounting portion 11, the winding shaft 27 is inserted into the winding core 109, and the winding rotation member 35 is engaged with the winding core 109. In this state, when the feeding motor 33 is operated, as the winding rotation member 35 rotates, the winding core 109 rotates, and the ink ribbon 117 sent out from the sending-out core 107 is wound on the winding core 109.

The head portion 29 includes a thermal head 37 and a head cover 39 covering the thermal head 37. When the tape cartridge 101 is mounted on the cartridge mounting portion 11, the head portion 29 is inserted into the head insertion hole 118. Further, when the mounting portion cover 5 is closed and blocked, the thermal head 37 moves toward the platen roller 105, and the tape 113 and the ink ribbon 117 are sandwiched in the platen roller 105. In this state, when the tape 113 and the ink ribbon 117 sandwiched between the thermal head 37 and the platen roller 105 are fed, the thermal head 37 generates heat based on input printing information. Accordingly, an ink of the ink ribbon 117 is transferred to the tape 113, and a character string or the like corresponding to the printing information is printed on the tape 113.

A sending-out side engagement protrusion 41 and a winding side engagement protrusion 43 are provided on a bottom surface of the cartridge mounting portion 11. When the tape cartridge 101 is mounted on the cartridge mounting portion 11, the sending-out side engagement protrusion 41 is engaged with the sending-out side hook 153. Accordingly, as the engagement between the sending-out side hook 153 and the sending-out core 107 is released, the sending-out core 107 can rotate. Similarly, when the tape cartridge 101 is mounted on the cartridge mounting portion 11, the winding side engagement protrusion 43 is engaged with the winding side hook 155. Accordingly, as the engagement between the winding side hook 155 and the winding core 109 is released, the winding core 109 can rotate.

The guide pin 45 protrudes from the bottom surface of the cartridge mounting portion 11 on the nearby side in the mounting direction. When the tape cartridge 101 is mounted on the cartridge mounting portion 11, the guide pin 45 is inserted into the second guide hole 159 or is inserted into both the first guide hole 157 and the second guide hole 159.

Accordingly, while being guided by the guide pin 45, the tape cartridge 101 is mounted on the deep side of the cartridge mounting portion 11. The guide pin 45 is an example of a "second protrusion portion" of the present disclosure. The guide pin 45 may not be provided in the cartridge mounting portion 11.

A first positioning protrusion 47 and a second positioning protrusion 49 are provided on the bottom surface of the cartridge mounting portion 11. When the tape cartridge 101 is mounted on the cartridge mounting portion 11, the first positioning protrusion 47 is inserted into the first positioning hole 161, and the second positioning protrusion 49 is inserted into the second positioning hole 163. Accordingly, the tape cartridge 101 is positioned inside a surface crossing the mounting direction with respect to the cartridge mounting portion 11.

Two presser hooks 51 protrude from the bottom surface of the cartridge mounting portion 11 on the nearby side in the mounting direction. When the tape cartridge 101 is mounted on the cartridge mounting portion 11, the pressing hook 51 is engaged with the pressing engagement portion 165. Accordingly, the tape cartridge 101 is pressed to the deep side in the mounting direction, and mounting of the tape cartridge 101 while the tape cartridge 101 floats from the bottom surface of the cartridge mounting portion 11 is suppressed.

Three height positioning protrusions 53 are provided on the bottom surface of the cartridge mounting portion 11. When the tape cartridge 101 is mounted on the cartridge mounting portion 11, the deep side wall portion 127 is in contact with the three height positioning protrusions 53. Accordingly, the tape cartridge 101 is positioned in the mounting direction, that is, the height direction, with respect to the cartridge mounting portion 11.

A first detection opening 59 and three second detection openings 55 are provided on the bottom surface of the cartridge mounting portion 11.

The second detection opening 55 is configured such that the second detection member 63 included in the second sensor 61 (see FIG. 12) can be protruded and inserted. The second detection member 63 protrudes from the second detection opening 55 in a state in which the tape cartridge 101 is not mounted on the cartridge mounting portion 11. When the tape cartridge 101 is mounted on the cartridge mounting portion 11, the second detection member 63 is retracted into the second detection opening 55 according to presence or absence of the hole to be detected 173 in the mounted tape cartridge 101. The three second sensors 61 output a 3-bit detection signal that differs according to combination of the presence or absence of the three holes to be detected 173 in the mounted tape cartridge 101. For example, a micro-switch can be used as the second sensors 61.

The first detection opening 59 is configured such that the first detection member 71 included in the first sensor 69 (see FIG. 12) can be protruded and inserted. The first detection opening 59 is an example of a "detection opening" of the present disclosure. The first detection member 71 is an example of an "actuator" of the present disclosure. The first detection member 71 protrudes from the first detection opening 59 on the nearby side in the mounting direction in a state in which the tape cartridge 101 is not mounted on the cartridge mounting portion 11. When the tape cartridge 101 is mounted on the cartridge mounting portion 11, the first detection member 71 is retracted into the first detection opening 59 according to presence or absence of the detection recess portion 175 in the mounted tape cartridge 101. However, the first detection member 71 is maintained to protrude from the first detection opening 59 on the nearby side in the mounting direction. That is, the first sensor 69 detects presence or absence of the detection recess portion 175 in the mounted tape cartridge 101, and outputs a 1-bit detection signal. For example, a micro-switch can be used as the first sensor 69. The first sensor 69 is an example of a "detection unit" of the present disclosure.

Here, in a plan view in a state in which the tape cartridge 101 is mounted on the cartridge mounting portion 11, the first detection member 71 protruding from the first detection opening 59 is provided opposite to the first area 130 with a shaft of the tape core 103 in between. In more detail, a contact portion 79 (see FIG. 10) of the first detection member 71, which will be described below, is provided over a device-side imaginary line 73 passing through the center of the insertion protrusion portion 23 and the center of the platen shaft 25 when viewed from the nearby side in the mounting direction. As described above, when the tape cartridge 101 is mounted on the cartridge mounting portion 11, the insertion protrusion portion 23 is inserted into the core insertion tube portion 143, and the platen shaft 25 is inserted into the platen roller 105. Therefore, according to the first detection member 71 provided over the device-side imaginary line 73 passing through the center of the insertion protrusion portion 23 and the center of the platen shaft 25, the first detection area 171, provided over the cartridge-side imaginary line 181 passing through the center of the core insertion tube portion 143 and the center of the platen roller 105, can be properly positioned. Even when the first detection member 71 is not over the device-side imaginary line 73, a configuration in which the first detection member 71 is provided in an area opposite to the platen shaft 25 with the insertion protrusion portion 23 in between can also obtain the same effect. Similarly, even when the first detection area 171 is not over the cartridge-side imaginary line 181, a configuration in which the first detection area 171 is provided in an area opposite to the platen roller 105 with the core insertion tube portion 143 in between can also obtain the same effect.

Further, the first detection member 71 is provided near the guide pin 45, specifically, between the guide pin 45 and an inner wall of the cartridge mounting portion 11 close to the guide pin 45 when viewed from the nearby side in the mounting direction. As described above, when the second tape cartridge 101 is mounted on the cartridge mounting portion 11, the guide pin 45 is inserted into the second guide hole 159. Therefore, according to the first detection member 71 provided close to the guide pin 45, the first detection area 171 provided close to the second guide hole 159 can be properly positioned. Further, when the tape cartridge 101 is mounted on the cartridge mounting portion 11, the first detection member 71 overlaps with the second peripheral wall portion 129 surrounding the tape accommodating area 120 and is provided in an area where the first detection member 71 is over one assembly pin insertion hole 133 among the six assembly pin insertion holes 133, in a plan view.

The first sensor 69 will be described with reference to FIGS. 10 and 11. The first sensor 69 includes a first sensor body 75 and the first detection member 71. A circuit element is provided in the first sensor body 75. The first detection member 71 includes an arm portion 77 and a contact portion 79. The arm portion 77 has a plate-like cross section and is formed in an arm shape extending in a direction in which the first sensor body 75 and the first detection opening 59 are connected to each other, that is, in the Y direction. The contact portion 79 is provided to be bent from an end portion of the arm portion 77 on the first detection opening 59 side on the nearby side in the mounting direction and to protrude from the first detection opening 59. When the first cartridge 177 without the detection recess portion 175 is mounted on the cartridge mounting portion 11, the contact portion 79 comes into contact with the first detection area 171 of the first cartridge 177. A leading end portion of the contact portion 79, which is in contact with the first detection area 171, has a contact surface formed in a rectangular shape, when viewed from the nearby side in the mounting direction. A portion of the first detection member 71, exposed from the first detection opening 59, that is, the contact portion 79, is located outside the tape accommodating area 120, in a plan view when the tape cartridge 101 is mounted on the cartridge mounting portion 11 (see FIG. 9). Further, the contact portion 79 is disposed at a position that is different from the first area 130 side of the tape accommodating area 120, that is, the −Y side. That is, the contact portion 79 is disposed on the +X side and the +Y side. In other words, the contact portion 79 is disposed opposite to the first area 130 with the shaft of the tape core 103 in between in a plan view when the tape cartridge 101 is mounted on the cartridge mounting portion 11. The "exposure" means a state in which the contact portion 79 of the first detection member 71 is retracted into the first detection opening 59 in addition to a state in which the contact portion 79 of the first detection member 71 protrudes from the first detection opening 59.

The first detection member 71 is provided with a not-illustrated rotary shaft at a substantially middle portion of the arm portion 77 in a longitudinal direction so as to be rotatable. That is, the first detection member 71 is configured to be rotatable between a first detection position where the contact portion 79 is retracted into the first detection opening 59 as illustrated in FIG. 10 and a second detection position where the contact portion 79 protrudes from the first detection opening 59 as illustrated in FIG. 11. The first detection member 71 receives a force from a detection spring 81 in a clockwise direction illustrated in FIG. 10, that is, a direction from the first detection position to the second detection position. The first sensor 69 outputs a first detection signal in a state in which the first detection member 71 is located at the first detection position, and outputs a second detection signal that is different from the first detection signal in a state in which the first detection member 71 is located at the second detection position.

Figure 10:
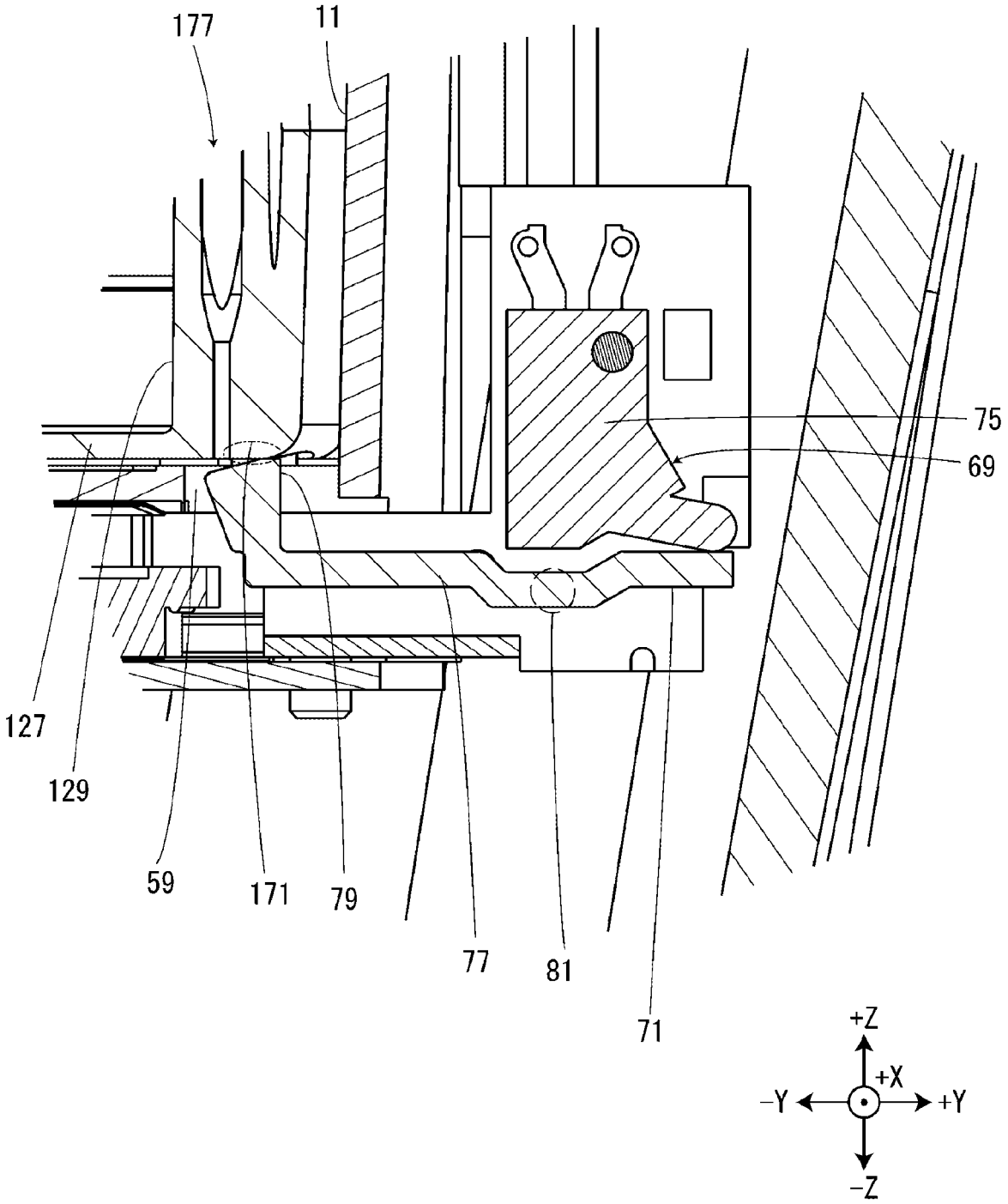
FIG. 10 is a partially sectional view taken along a cutting line X-X of FIG. 2 in a state in which the first cartridge is mounted.

As illustrated in FIG. 10, when the first cartridge 177 is mounted on the cartridge mounting portion 11, as described above, in the first cartridge 177, the detection recess portion 175 is not provided in the first detection area 171. Thus, the contact portion 79 protruding from the first detection opening 59 is pressed by the first detection area 171 and the first detection member 71 rotates from the second detection position to the first detection position against the detection spring 81. Therefore, when the first cartridge 177 is mounted on the cartridge mounting portion 11, the first sensor 69 outputs the first detection signal.

While the first cartridge 177 is mounted on the cartridge mounting portion 11, the first detection member 71 is pressed to the first detection area 171 by a spring force of the detection spring 81. Here, as described above, the first detection area 171 is provided at a position overlapping with the second peripheral wall portion 129, when viewed from the deep side in the mounting direction. Therefore, the second peripheral wall portion 129 receives a reaction force of a force by which the first detection area 171 presses the first detection member 71. Here, as compared to a case where only the deep side wall portion 127 presses the first detection member 71, as the second peripheral wall portion 129 extending in the mounting direction presses the first detection member 71, the first detection member 71 can be pressed stably.

Further, when rotating from the second detection position to the first detection position, the first detection member 71 is rotatably provided such that a contact position between the deep side wall portion 127 and the contact portion 79 is displaced toward an inside of the deep side wall portion 127. Further, the leading end portion of the contact portion 79, which is in contact with the first detection area 171, has a contact surface formed in a rectangular shape, when viewed from the nearby side in the mounting direction. For this reason, even when an edge portion of the first detection area 171, which has an arc-shaped cross section and intersects the deep side wall portion 127 and the second peripheral wall portion 129, comes into contact with the contact portion 79, the contact portion 79 is displaced toward the inside of the deep side wall portion 127. Accordingly, the contact state between the contact portion 79 and the first detection region 171 can be maintained and the first detection member 71 can be properly rotated to the first detection position. Further, even when the assembly pin insertion hole 133 and the second guide hole 159 among the first detection area 171 come into contact with the contact portion 79, the contact surface of the contact portion 79, formed in a rectangular shape, comes into contact with an opening edge portion of the assembly pin insertion hole 133 or the second guide hole 159. Therefore, the contact portion 79 is displaced toward the inside of the deep side wall portion 127. Accordingly, the contact state between the contact portion 79 and the first detection region 171 can be maintained and the first detection member 71 can be properly rotated to the first detection position.

Figure 11:
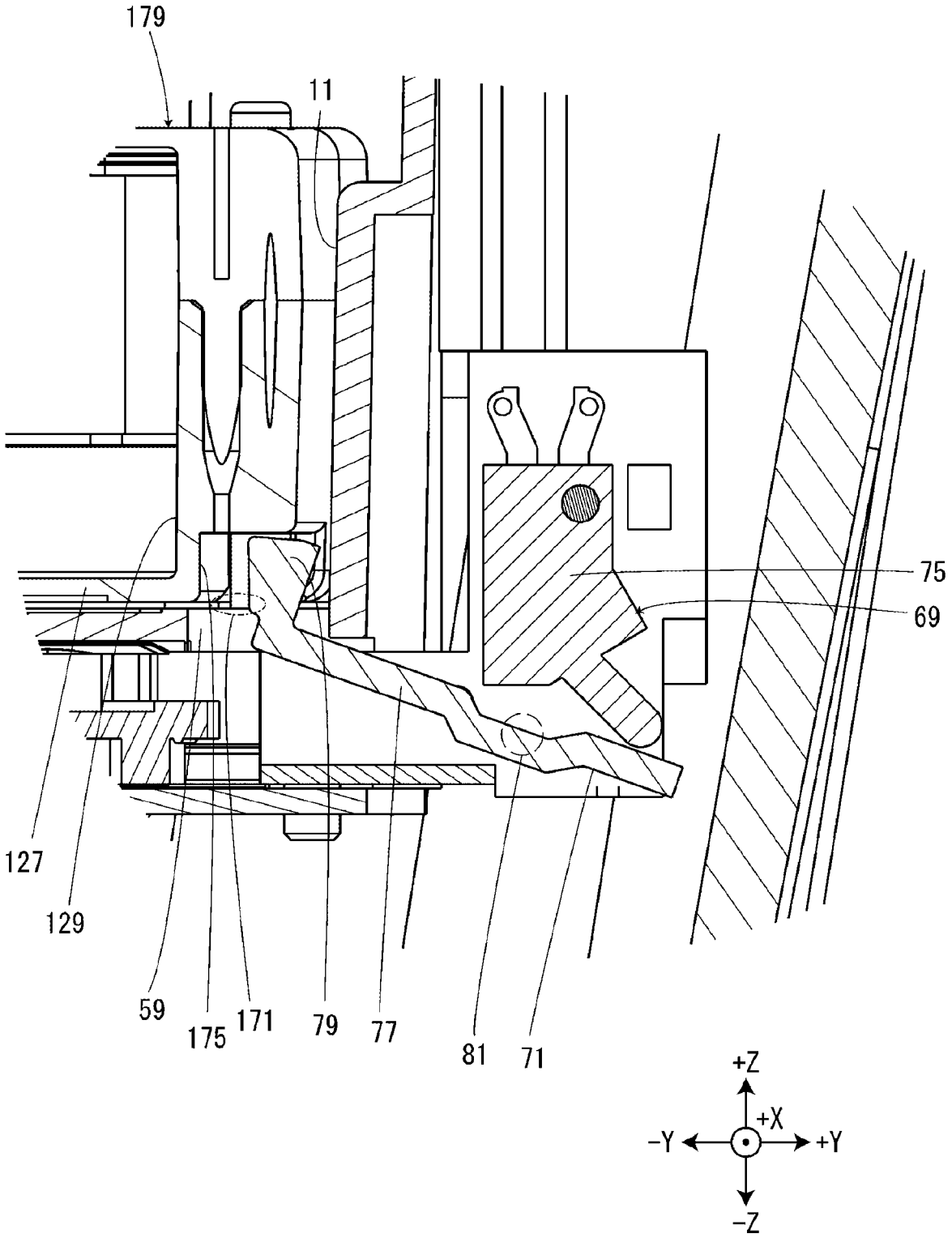
FIG. 11 is a partially sectional view taken along a cutting line XI-XI of FIG. 2 in a state in which the second cartridge is mounted.

Meanwhile, as illustrated in FIG. 11, when the second cartridge 179 is mounted on the cartridge mounting portion 11, as described above, in the second cartridge 179, the detection recess portion 175 is provided in the first detection area 171. Thus, the contact portion 79 protruding from the first detection opening 59 is not pressed by the first detection area 171 and the first detection member 71 remains positioned at the second detection position. That is, the detection recess portion 175 prevents the first detection member 71 from being retracted when the second cartridge 179 is mounted on the cartridge mounting portion 11. Therefore, when the second cartridge 179 is mounted on the cartridge mounting portion 11, the first sensor 69 outputs the second detection signal.

A control system of the tape printing device 1 will be described with reference to FIG. 12. The tape printing device 1 includes a control circuit 83 in addition to the operation panel 7, the display 9, the feeding motor 33, the cutter motor 21, the first sensor 69, and the second sensor 61. Although not illustrated, the control circuit 83 includes a processor and a memory. The control circuit 83 controls the display 9, the feeding motor 33, and the cutter motor 21 based on the operation panel 7 and the detection signals from the first sensor 69 and the second sensor 61. For example, the control circuit 83 acquires the width of the tape 113 of the tape cartridge 101 mounted on the cartridge mounting portion 11 based on the detection signal from the second sensor 61, and displays the acquired width of the tape 113 on the display 9. Further, the control circuit 83 controls the cutter motor 21 based on the detection signal from the first sensor 69. When the tape printing device 1 is powered on, the first sensor 69 outputs the first detection signal or the second detection signal to the control circuit 83, at a time point when the tape cartridge 101 is mounted on the cartridge mounting portion 11.

Figure 13:
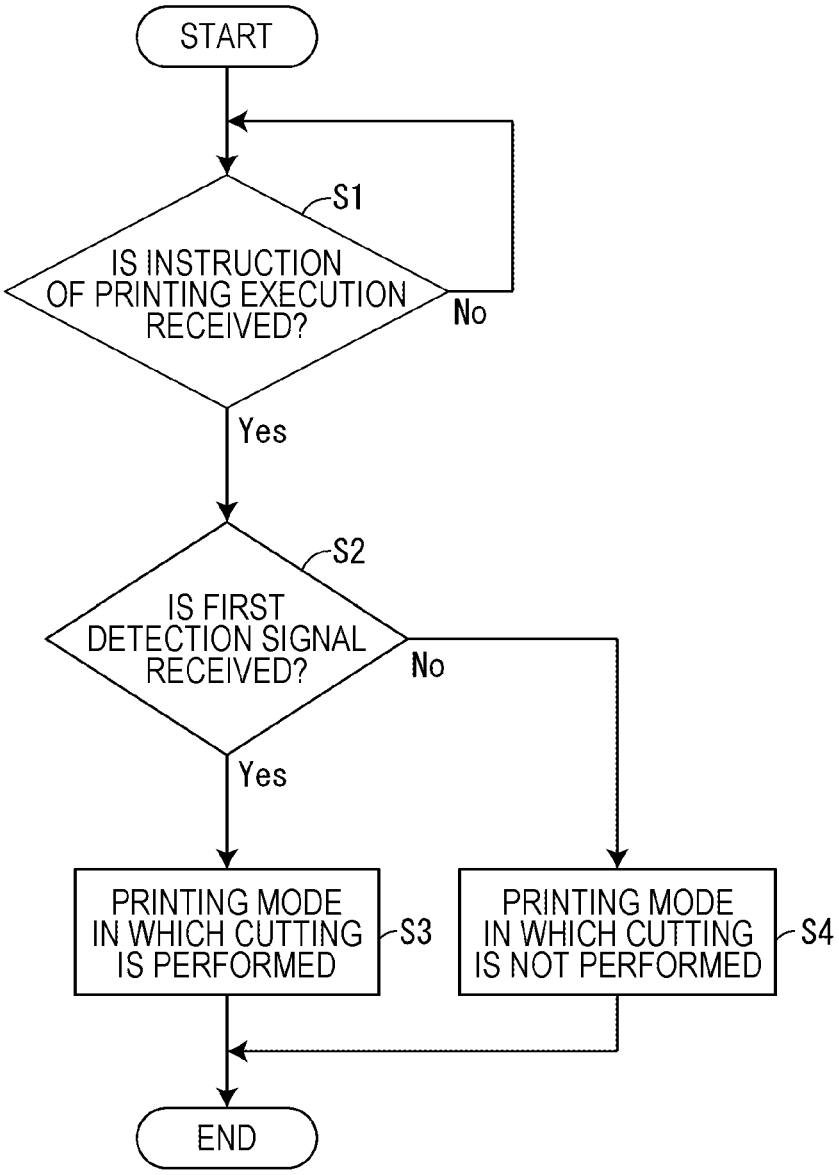
FIG. 13 is a flowchart illustrating a series of processes of controlling a cutter motor by a control circuit.

Flow of a series of processes in which the control circuit 83 controls the cutter motor 21 will be described with reference to FIG. 13. In step S1, the control circuit 83 determines whether or not an instruction to execute printing has been received. When it is determined that the instruction to execute the printing is received (S1; Yes), the control circuit 83 proceeds to step S2. When it is been determined that the instruction to execute the printing is not received (S1; No), the control circuit 83 repeats step S1.

In step S2, the control circuit 83 determines whether or not the first detection signal is received from the first sensor 69. When it is determined that the first detection signal is received from the first sensor 69 (S2; Yes), the control circuit 83 proceeds to step S3. When it is determined that the second detection signal is received from the first sensor 69, that is, when it is determined that the first detection signal is not received, (S2; No), the control circuit 83 proceeds to step S4.

In step S3, the control circuit 83 executes a printing mode with cutting. In the printing mode with cutting, the control circuit 83 executes printing processing, and operates the full cutter 17 or the half cutter 19 at a time point when the tape 113 is fed by a desired length. A time point when the tape 113 is fed by a desired length includes, for example, a time point when a rear end portion of a label is fed to a cutting position of the full cutter 17, a time point when a boundary portion between labels is fed to a cutting position of the half cutter 19 when a plurality of labels are continuously printed, and the like. In this way, when the first cartridge 177 accommodating the tape 113 that does not affect a cutting function of the full cutter 17 or the half cutter 19 is mounted on the cartridge mounting portion 11, the first detection signal is output from the first sensor 69. As a result, the full cuter 17 can be operated to cut the tape 113, and the half cutter 19 can be operated to form a cut on one surface of the tape 113.

In step S4, the control circuit 83 executes a printing mode without cutting. In the printing mode without cutting, the control circuit 83 executes the printing processing without operating the full cutter 17 and the half cutter 19. That is, the full cutter 17 and the half cutter 19 can be automatically set not to operate without inputting from the operation panel 7 whether or not a user operates the full cutter 17 and the half cutter 19. In this case, the user may cut the tape 113 using scissors or the like possessed as needed. In this way, when the second cartridge 179 accommodating the tape 113 that affects the cutting function of the full cutter 17 or the half cutter 19 is mounted on the cartridge mounting portion 11, the second detection signal is output from the first sensor 69. As a result, the full cutter 17 and the half cutter 19 do not operate, and an influence on the cutting function of the full cutter 17 and the half cutter 19 can be suppressed. In the printing mode without cutting, the control circuit 83 may cause the display 9 to display that the full cutter 17 and the half cutter 19 are not operated.

Further, in the printing mode without cutting, the control circuit 83 may be configured to operate the half cutter 19 without operating the full cutter 17. This configuration is particularly effective when the tape 113 accommodated in the second cartridge 179 may affect the cutting function of the full cutter 17 but may have little risk of affecting the cutting function of the half cutter 19. In contrast, in the printing mode without cutting, the control circuit 83 may be configured to operate the full cutter 17 without operating the half cutter 17. This configuration is particularly effective when the tape 113 accommodated in the second cartridge 179 may have little risk of affecting the cutting function of the full cutter 17 but may affect the cutting function of the half cutter 19. Further, the tape printing device 1 is not limited to a configuration including both the full cutter 17 and the half cutter 19 and may be configured to include only one of the full cutter 17 and the half cutter 19.

In the above embodiment, in the tape printing device 1, the control circuit 83 or the first sensor 69 are provided with circuit elements, and the cutter motor 21 is controlled based on the detection signal from the first sensor 69. However, the embodiment of the present disclosure is not limited thereto. For example, the circuit element is not provided and a locking member for mechanically locking an operation of the full cutter 17 or the half cutter 19 is provided. A rotational position and a rotational angle of the first detection member 71 are detected, and the tape printing device 1 may be configured to have a mechanical configuration that switches whether or not locking by the locking member is released based on a result of the detection.

As described above, the tape printing device 1 according to the present embodiment includes the first detection member 71, and the first detection member 71 includes the contact portion 79 exposed from the first detection opening 59. The contact portion 79 is located outside the tape accommodating area 120, in a plan view when the tape cartridge 101 is mounted on the cartridge mounting portion 11. Further, the contact portion 79 is provided at a position that is different from the first area 130 side of the tape accommodating area 120.

With this configuration, since the contact portion 79 is provided outside the tape accommodating area 120, volume efficiency of the tape cartridge 101 can be maintained. That is, the maximum length of the tape 113 that can be accommodated in the tape cartridge 101 can be maintained. Further, since the contact portion 79 is provided at a position that is different from the first area 130 side of the tape accommodating area 120, a detector can be added to a bottom surface of the cartridge mounting portion 11.

In the above-described tape printing device 1, the contact portion 79 exposed from the first detection opening 59 may be provided opposite to the first area 130 with the shaft of the tape core 103 in between in a plan view when the tape cartridge 101 is mounted on the cartridge mounting portion 11.

With this configuration, according to the first detection member 71 provided over the device-side imaginary line 73 passing through the center of the insertion protrusion portion 23 and the center of the platen shaft 25, the first detection area 171, provided over the cartridge-side imaginary line 181 passing through the center of the core insertion tube portion 143 and the center of the platen roller 105, can be properly positioned.

In the above-described tape printing device 1, the contact portion 79 exposed from the first detection opening 59 may be provided at a position overlapping with the second peripheral wall portion 129 in a plan view when the tape cartridge 101 is mounted on the cartridge mounting portion 11.

With this configuration, since the contact portion 79 is provided at the position overlapping with the second peripheral wall portion 129, volume efficiency of the tape cartridge 101 can be maintained. Further, the detector can be added to the bottom surface of the cartridge mounting portion 11.

The above-described tape printing device 1 further includes the platen shaft 25 inserted into the platen roller 105 of the tape cartridge 101 and the insertion protrusion portion 23 inserted into the core insertion tube portion 143 of the tape cartridge 101. The first detection member 71 may be provided opposite to the platen shaft 25 with the insertion protrusion portion 23 in between in a plan view.

With this configuration, according to the first detection member 71 provided over the device-side imaginary line 73 passing through the center of the insertion protrusion portion 23 and the center of the platen shaft 25, the first detection area 171, provided over the cartridge-side imaginary line 181 passing through the center of the core insertion tube portion 143 and the center of the platen roller 105, can be properly positioned.

In the above-described tape printing device 1, the cartridge case 111 of the tape cartridge 101 is configured by combining the nearby side case 119 and the deep side case 121. The assembly pin is provided on one of the nearby side case 119 and the deep side case 121 and the assembly pin insertion hole 133 is provided on the other one of the nearby side case 119 and the deep side case 121. When the tape cartridge 101 is mounted on the cartridge mounting portion 11, the first detection member 71 is provided in an area over the assembly pin insertion hole 133 in a plan view.

With this configuration, since the first detection member 71 is provided in an area over the assembly pin insertion hole 133, volume efficiency of the tape cartridge 101 can be maintained. Further, the detector can be added to the bottom surface of the cartridge mounting portion 11.

In the above-described tape printing device 1, the tape cartridge 101 includes the first cartridge 177 for retracting the first detection member 71 into the first detection opening 59 and the second cartridge 179 for maintaining the first detection member 71 protruding from the first detection opening 59. The first sensor 69 may output the first detection signal based on a position of the first detection member 71 when the first cartridge 177 is mounted on the cartridge mounting portion 11, and may output the second detection signal that is different from the first detection signal based on the position of the first detection member 71 when the second cartridge 179 is mounted on the cartridge mounting portion 11.

With this configuration, the first sensor 69 outputs the first detection signal and the second detection signal based on the position of the first detection member 71. Therefore, it is possible to appropriately detect the tape cartridge 101 mounted on the cartridge mounting portion 11 is the first cartridge 177 or the second cartridge 179.

Further, the second cartridge 179 according to the present embodiment can be mounted on the cartridge mounting portion 11. In the cartridge mounting portion 11, the insertion protrusion portion 23 is provided between the first detection member 71 and the platen shaft 25. The second cartridge 179 includes the cartridge case 111 provided with the detection recess portion 175. In a state in which the second cartridge 179 is mounted on the cartridge mounting portion 11, the detection recess portion 175 is provided at a position overlapping with the first detection member 71 in a plan view.

With this configuration, the detection recess portion 175 is provided at a position overlapping with the first detection member 71 provided at a position with the insertion protrusion portion 23 interposed between the platen shaft 25 and the first detection member 71. Accordingly, the detector can be added to the bottom surface of the cartridge mounting portion 11.

Further, the tape cartridge 101 according to the present embodiment includes the cartridge case 111 provided with the first detection area 171. In the first detection member 171, the first detection member 71 is positioned in a state in which the tape cartridge 101 is mounted on the cartridge mounting portion 11.

With this configuration, the first detection area 171 is provided at a position where the first detection member 71 provided at a position with the insertion protrusion portion 23 interposed between the platen shaft 25 and the first detection member 71 is located. Accordingly, the detector can be added to the bottom surface of the cartridge mounting portion 11.

Further, in a plan view when the tape cartridge 101 according to the present embodiment is mounted on the cartridge mounting portion 11, the first detection area 171 corresponding to the contact portion 79 of the first detection member 71 among the deep side wall portion 127 of the cartridge case 111 is located outside the tape accommodating area 120. Further, the first detection area 171 is located opposite to the first area 130 with the tape accommodating area 120 in between.

With this configuration, since the first detection area 171 is provided outside the tape accommodating area 120, the volume efficiency of the tape cartridge 101 can be maintained. Further, since the first detection area 171 is provided opposite to the first area 130 with the tape accommodating area 120 in between, the detector can be added to the bottom surface of the cartridge mounting portion 11.

Further, in the tape cartridge 101 according to the present embodiment, the first detection area 171 is provided at a peripheral edge portion in which the second peripheral wall portion 129 among the surface of the deep side wall portion 127 on the deep side in the mounting direction stands upright.

With this configuration, since the first detection area 171 is provided at the peripheral edge portion on the surface of the deep side wall portion 127 on the deep side in the mounting direction, the volume efficiency of the tape cartridge 101 can be maintained.

Further, the tape cartridge set includes the first cartridge 177 and the second cartridge 179 according to the present embodiment. In the cartridge mounting portion 11 on which the first cartridge 177 and the second cartridge 179 are selectively mounted, the first detection member 71 is provided in an area opposite to the platen shaft 25 with the insertion protrusion portion 23 in between. The first detection area 171 is provided in the first cartridge 177 for positioning the first detection member 71 at the first detection position when the first cartridge 177 is mounted on the cartridge mounting portion 11. The first detection area 171 is provided in the second cartridge 179 for positioning the first detection member 71 at the second detection position when the second cartridge 179 is mounted on the cartridge mounting portion 11.

With this configuration, the first detection area 171 positions the first detection member 71, provided opposite to the platen shaft 25 with the insertion protrusion portion 23 in between, at the first detection position or the second detection position. Accordingly, the detector can be added to the bottom surface of the cartridge mounting portion 11.

The present disclosure is not limited to the above-described embodiments, and may adopt various configurations without departing from the spirit of the present disclosure. For example, in addition to the above, the above-described embodiments can be changed to the following forms.

The first detection member 71 is not limited to a configuration provided near the guide pin 45 when viewed from the nearby side in the mounting direction. For example, the first detection member 71 may be provided near the first positioning hole 161. In other words, the first detection member 71 may be provided in an area opposite to the sending-out core 107 and the second positioning hole 163 with the core insertion tube portion 143 in between.

The detection recess portion 175 is not limited to a concave configuration of which the deep side in the mounting direction and the outer peripheral side are open, and for example, may be formed in a concave shape of which the nearby side in the mounting direction is opened in addition to the deep side in the mounting direction and the outer peripheral side. That is, the detection recess portion 175 may be formed in a concave shape communicating with the deep side wall portion 127 from the nearby side wall portion 123.

The tape printing device 1 operates the full cutter 17 and the half cutter 19 when the first cartridge 177 without the detection recess portion 175 provided is mounted and the first detection signal is output from the first sensor 69. Further, the present disclosure is not limited to a configuration in which the tape printing device 1 operates the full cutter 17 and the half cutter 19 when the second cartridge 179 provided with the detection recess portion 175 is mounted and the second detection signal is output from the first sensor 69, and for example, may have a configuration opposite thereto. That is, the tape printing device 1 may be configured to operate the full cutter 17 and the half cutter 19 when the first cartridge 177 without the detection recess portion 175 provided is mounted, and the first detection signal is output from the first sensor 69, and may be configured to operate the full cutter 17 and the half cutter 19 when the second cartridge 179 provided with the detection recess portion 175 is mounted, and the second detection signal is output from the first sensor 69. In this configuration, the tape 113 which may affect the cutting function of the full cutter 17 and the half cutter 19 may be accommodated in the first cartridge 177, and the tape 113 which has little risk of affecting the cutting function of the full cutter 17 and the half cutter 19 may be accommodated in the second cartridge 179.

The first sensor 69 is not limited to a configuration of detecting whether or not the tape 113 accommodated in the mounted tape cartridge 101 is the tape 113 that may affect the cutting function of the full cutter 17 and the half cutter 19. For example, the first sensor 69 may detect whether or not the tape 113 accommodated in the mounted tape cartridge 101 is the tape 113 that needs to increase printing energy by the thermal head 37. That is, for example, when the first cartridge 177 accommodating the tape 113 that does not need to increase the printing energy is mounted, and the first detection signal is output from the first sensor 69, the tape printing device 1 drives the thermal head 37 using first printing energy. When the second cartridge 179 accommodating the tape 113 that does not need to increase the printing energy is mounted, and the second detection signal is output from the first sensor 69, the tape printing device 1 drives the thermal head 37 using second printing energy that is higher than the first printing energy.

The first detection member 71 is not limited to a configuration in which the first detection member 71 rotates to be protruded from and retracted and inserted into the first detection opening 59, and may a configuration in which the first detection member 71 is advanced and retracted in the mounting direction to be protruded from and retracted into the first detection opening 59.

Further, the first detection member 71 may detect the first detection signal and the second detection signal to select the first cartridge 177 and the second cartridge 179 according to whether or not a protrusion for pressing the first detection member 71 is provided on the tape cartridge 101. That is, the protrusion may be not provided in the first cartridge 177, and the protrusion is provided in the second cartridge 179. At this time, the first detection member 71 may protrude from the first detection opening 59 as the first detection position or may not protrude. Here, when the first detection member 71 does not protrude from the first detection opening 59, although the first detection member 71 does not protrude from the first detection opening 59 at the first detection position, a state in which the first detection member 71 retracted into the first detection opening 59 is visually recognized in a plan view, that is, a state in which the first detection member 71 is exposed is included. When the first detection member 71 does not protrude from the first detection opening 59, the protrusion for pressing the first detection member 71 is inserted into the first detection opening 59, so that the first detection member 71 may be located from the first detection position to the second detection position when the second cartridge 179 is mounted.

What is claimed is:

1. A tape printing device comprising:

a cartridge mounting portion on which a tape cartridge is mounted;

a detection unit that has an actuator configured to be protruded from and retracted into a detection opening provided on a bottom surface of the cartridge mounting portion, and detects a type of a printing tape accommodated in the tape cartridge; and a thermal head that performs printing on the printing tape, wherein the tape cartridge has a cartridge case having a bottom wall portion facing the bottom surface of the cartridge mounting portion when the tape cartridge is mounted on the cartridge mounting portion and a peripheral wall portion standing upright from a peripheral edge portion of the bottom wall portion, the cartridge case includes an ink ribbon accommodating area accommodating an ink ribbon, a sending-out core on which the ink ribbon is wound, and a winding core on which the ink ribbon is wound, a head insertion hole into which the thermal head and a head cover covering the thermal head are inserted when the tape cartridge is mounted on the cartridge mounting portion, a first area including the ink ribbon accommodating area and the head insertion hole, and a tape accommodating area accommodating the printing tape and a tape core on which the printing tape is wound, and a portion of the actuator, exposed from the detection opening, is located outside the tape accommodating area and is provided at a position on a side of the tape accommodating area different from a side of a first area including the ink ribbon accommodating area and the head insertion hole in a plan view when the tape cartridge is mounted on the cartridge mounting portion.

2. The tape printing device according to claim 1, further comprising:

a protrusion portion provided at the cartridge mounting portion and inserted into a core insertion tube portion included in the tape cartridge, wherein the portion of the actuator, exposed from the detection opening, is provided opposite to the first area with a shaft of the tape core in between in a plan view when the tape cartridge is mounted on the cartridge mounting portion.

3. The tape printing device according to claim 1, wherein the actuator has a contact portion having one end protruding from the detection opening and being in contact with the mounted tape cartridge, and when the tape cartridge is mounted on the cartridge mounting portion, the contact portion of the actuator is provided at a position overlapping with the peripheral wall portion of the tape cartridge in a plan view.

4. The tape printing device according to claim 1, further comprising:

a platen shaft provided at the cartridge mounting portion and inserted into a platen roller included in the tape cartridge, wherein the actuator is provided opposite to the platen shaft with the protrusion portion in between, in a plan view.

5. The tape printing device according to claim 1, wherein the cartridge case is configured by combining a first case and a second case, an assembly pin is provided in one of the first case and the second case, and an assembly pin insertion hole is provided on the other one of the first case and the second case, and when the tape cartridge is mounted on the cartridge mounting portion, the actuator is provided at an area over the assembly pin insertion hole in a plan view.

6. The tape printing device according to claim 1, wherein the detection unit outputs a first detection signal based on a position of the actuator, when a first cartridge for retracting the actuator into the detection opening is mounted on the cartridge mounting portion, and outputs a second detection signal different from the first detection signal based on the position of the actuator, when a second cartridge having a recess portion and for maintaining the actuator protruding from the detection opening is mounted on the cartridge mounting portion.

7. A tape cartridge configured to be mounted on a cartridge mounting portion of a tape printing device, the tape printing device including a first protrusion portion provided at a position, corresponding to a tape roller, on a bottom surface of the cartridge mounting portion, a platen shaft provided on the bottom surface of the cartridge mounting portion, a second protrusion portion provided on the bottom surface of the cartridge mounting portion, and a detection unit having an actuator configured to be protruded from and retracted into the bottom surface of the cartridge mounting portion and a main sensor body configured to generate a detection signal based on a position of the actuator, the first protrusion portion being located between the second protrusion portion or the actuator and the platen shaft, the tape cartridge comprising:

a cartridge case having a recess portion and an opening into which the second protrusion portion is inserted, and accommodating the tape roller; and a platen roller which is disposed inside the cartridge case and into which the platen shaft is inserted, wherein in the cartridge case, in a state in which the tape cartridge is mounted on the cartridge mounting portion, the recess portion serving as a portion to be detected is provided at a position overlapping with the actuator, in a plan view.

8. The tape cartridge according to claim 7, wherein the cartridge case has an opposite surface facing the bottom surface of the cartridge mounting portion in a state in which the tape cartridge is mounted on the cartridge mounting portion, and the recess portion is provided at a peripheral edge of the cartridge case on a side of the opposite surface, and, when a direction in which the tape cartridge is mounted on the cartridge mounting portion is a mounting direction, in a state in which the tape cartridge is mounted on the cartridge mounting portion, the recess portion has a bottom portion at a position away from the cartridge mounting portion as compared to the opposite surface in the mounting direction, and a peripheral wall of the recess portion forms a peripheral wall of the cartridge case.

9. The tape cartridge according to claim 8, wherein the opening into which the second protrusion portion is inserted is provided on the bottom portion of the recess portion.

10. A tape cartridge configured to be mounted on a cartridge mounting portion of a tape printing device, the tape printing device including a first protrusion portion provided at a position, corresponding to a tape roller, on a bottom surface of the cartridge mounting portion, a platen shaft provided on the bottom surface of the cartridge mounting portion, a second protrusion portion provided on the bottom surface of the cartridge mounting portion, and a detection unit having an actuator configured to be protruded from and retracted into a surface of the cartridge mounting portion and a main sensor body configured to generate a detection signal based on a position of the actuator, the first protrusion portion being located between the second protrusion portion or the actuator and the platen shaft, the tape cartridge comprising:

a cartridge case having an opening into which the second protrusion portion is inserted and accommodating the tape roller; and a platen roller which is disposed inside the cartridge case, and into which the platen shaft is inserted, wherein in the cartridge case, in a state in which the tape cartridge is mounted on the cartridge mounting portion, an area to be detected where the actuator is located is provided.

11. The tape cartridge according to claim 10, wherein the cartridge case is configured by combining a first case and a second case, an assembly pin is provided in one of the first case and the second case and an assembly pin insertion hole is provided on the other one of the first case and the second case, and the area to be detected is provided in an area overlapping with the assembly pin insertion hole, in a plan view.

12. A tape cartridge mounted on a cartridge mounting portion of a tape printing device including the cartridge mounting portion, a detection unit that detects a type of a printing tape of the tape cartridge using an actuator configured to be protruded from and retracted into a detection opening provided on a bottom surface of the cartridge mounting portion, and a thermal head that performs printing on the printing tape, the tape cartridge comprising a cartridge case including a bottom wall portion facing the bottom surface of the cartridge mounting portion and a peripheral wall portion standing upright from a peripheral edge portion of the bottom wall portion in a state in which the tape cartridge is mounted on the cartridge mounting portion, wherein the cartridge case includes an ink ribbon accommodating area accommodating an ink ribbon, a sending-out core on which the ink ribbon is wound, and a winding core on which the ink ribbon is wound, a head insertion hole into which the thermal head is inserted when the tape cartridge is mounted on the cartridge mounting portion, a first area configured with the ink ribbon accommodating area and the head insertion hole, and a tape accommodating area accommodating the printing tape and a tape core on which the printing tape is wound, and in a plan view when the tape cartridge is mounted on the cartridge mounting portion, an area, corresponding to a portion of the actuator exposed from the detection opening, in the bottom wall portion of the cartridge case, is located outside the tape accommodating area, and is located opposite to the first area with the tape accommodating area in between.

13. A tape cartridge mounted on a cartridge mounting portion of a tape printing device including the cartridge mounting portion, and a detection unit that detects a type of a printing tape of the tape cartridge using an actuator configured to be protruded from and retracted into a detection opening provided on a bottom surface of the cartridge mounting portion, the tape cartridge comprising a cartridge case including a bottom wall portion including an opposite surface facing the bottom surface of the cartridge mounting portion and a peripheral wall portion standing upright from a peripheral edge portion of the bottom wall portion, when the tape cartridge is mounted on the cartridge mounting portion, wherein an area to be detected, detected by the actuator protruding from the detection opening of the tape printing device when the tape cartridge is mounted on the cartridge mounting portion, is provided in the peripheral edge portion from which the peripheral wall portion stands upright on the opposite surface of the bottom wall portion.

14. A tape cartridge set having a first cartridge and a second cartridge and configured to be mounted on a cartridge mounting portion of a tape printing device, the tape printing device including a first protrusion portion provided at a position, corresponding to a tape roller, on a bottom surface of the cartridge mounting portion, a platen shaft provided on the bottom surface of the cartridge mounting portion, a second protrusion portion provided on the bottom surface of the cartridge mounting portion, and a detection unit including an actuator configured to be protruded from and retracted into a detection opening provided in the cartridge mounting portion and a main sensor body configured to generate a detection signal based on a position of the actuator, the main sensor body generating a first detection signal based on a first detection position of the actuator, when the first cartridge is mounted on the cartridge mounting portion, the main sensor body generating a second detection signal based on a second detection position of the actuator, when the second cartridge is mounted on the cartridge mounting portion, the second protrusion portion and the actuator being located in an area opposite to the platen shaft with the first protrusion portion in between, wherein the actuator is retracted into the detection opening, when the first cartridge is mounted on the cartridge mounting portion, and the actuator is maintained to be protruded from the detection opening, when the second cartridge is mounted on the cartridge mounting portion, the first cartridge includes a first cartridge case having a first opening into which the second protrusion portion is inserted, a first tape roller disposed inside the first cartridge case, and a first platen roller which is disposed inside the first cartridge case and into which the platen shaft is inserted, and a first area to be detected in which the actuator of the tape printing device is located in the first detection position is provided in a state in which the first cartridge is mounted on the cartridge mounting portion, and the second cartridge includes a second cartridge case having a second opening into which the second protrusion portion is inserted, a second tape roller disposed inside the second cartridge case, and a second platen roller which is disposed inside the second cartridge case and into which the platen shaft is inserted, and a second area to be detected in which the actuator of the tape printing device is located at the second detection position is provided in a state in which the second cartridge is mounted on the cartridge mounting portion.

* * * * *